US011355861B2

(12) United States Patent
Thyagarajan et al.

(10) Patent No.: US 11,355,861 B2
(45) Date of Patent: Jun. 7, 2022

(54) PATCH ANTENNA ARRAY SYSTEM

(71) Applicant: AVX Antenna, Inc., San Diego, CA (US)

(72) Inventors: Mukund Ranga Thyagarajan, San Diego, CA (US); Behrouz Babakhani, San Diego, CA (US); Francisco Carlos Sanchez Ortiz, San Diego, CA (US); Weichun Eric Lin, San Diego, CA (US)

(73) Assignee: KYOCERA AVX Components (San Diego), Inc., San Diego, CA (US)

( * ) Notice: Subject to any disclaimer, the term of this patent is extended or adjusted under 35 U.S.C. 154(b) by 0 days.

(21) Appl. No.: 16/580,134

(22) Filed: Sep. 24, 2019

(65) Prior Publication Data

US 2020/0106193 A1 Apr. 2, 2020

Related U.S. Application Data

(60) Provisional application No. 62/739,508, filed on Oct. 1, 2018.

(51) Int. Cl.

| | |
|---|---|
| ***H01Q 21/06*** | (2006.01) |
| ***H01Q 5/50*** | (2015.01) |
| ***H01Q 21/22*** | (2006.01) |
| ***H01Q 9/04*** | (2006.01) |

(52) U.S. Cl.

CPC ..... *H01Q 21/065* (2013.01); *H01Q 5/50* (2015.01); *H01Q 9/0428* (2013.01); *H01Q 9/0435* (2013.01); *H01Q 21/22* (2013.01)

(58) Field of Classification Search

CPC ..... H01Q 21/065; H01Q 5/50; H01Q 9/0428; H01Q 21/22; H01Q 9/0435

See application file for complete search history.

(56) References Cited

U.S. PATENT DOCUMENTS 4,866,451 A * 9/1989 Chen ..... H01Q 9/0428 343/700 MS
5,661,494 A * 8/1997 Bondyopadhyay .... H01Q 1/364 343/700 MS (Continued)

FOREIGN PATENT DOCUMENTS

KR 10-2009-0057537 6/2009

OTHER PUBLICATIONS

PCT International Search Report and Written Opinion for corresponding PCT Application No. PCT/US2019/052605, dated Jan. 10, 2020, 10 pages.

*Primary Examiner* — Andrea Lindgren Baltzell
*Assistant Examiner* — Yonchan J Kim
(74) *Attorney, Agent, or Firm* — Dority & Manning, P.A.

(57) ABSTRACT

A patch antenna array system is provided. The patch antenna array system can include a plurality of patch antennas oriented with respect to each other to provide a nearly symmetric radiation pattern over a range of frequencies, such as from 1500 Megahertz (MHz) to 1700 MHz. The patch antenna array system can include a sequential phase feed network that is in communication with the plurality of patch antennas. The sequential phase feed network can be configured to provide a radio frequency (RF) signal to each patch antenna of the plurality of patch antennas such that the patch antenna array system has an axial ratio of less than 1 decibel (dB) over the range of frequencies.

20 Claims, 21 Drawing Sheets

(56) References Cited

U.S. PATENT DOCUMENTS

| | | | | |
|---|---|---|---|---|
| 8,698,675 | B2 * | 4/2014 | Shtrom | H01Q 9/0471 343/702 |
| 2004/0239567 | A1 * | 12/2004 | Van Der Poel | H01Q 13/106 343/700 MS |
| 2007/0085741 | A1 * | 4/2007 | Rafi | H01Q 9/0407 343/700 MS |
| 2009/0219219 | A1 | 9/2009 | Pintos et al. | |
| 2010/0295729 | A1 | 11/2010 | Nogami | |
| 2011/0032166 | A1 * | 2/2011 | Zhang | H01Q 5/00 343/767 |
| 2013/0057427 | A1 * | 3/2013 | Haberland | G01S 13/931 342/165 |
| 2016/0218438 | A1 | 7/2016 | Miraftab et al. | |
| 2017/0062952 | A1 | 3/2017 | Sundararajan et al. | |
| 2020/0076082 | A1 * | 3/2020 | Nasimuddin | H01Q 9/045 |

* cited by examiner

PATCH ANTENNA ARRAY SYSTEM

PRIORITY CLAIM

The present application claims the benefit of priority of U.S. Provisional App. No. 62/739,508, titled "Patch Antenna Array System," having a filing date of Oct. 1, 2018, which is incorporated herein by reference.

FIELD

The present disclosure relates generally to patch antenna array systems.

BACKGROUND

Patch antennas can be used to facilitate communication between two devices. For example, patch antennas can be used to facilitate communication with a satellite. Patch antenna can convert electrical signals into radio frequency (RF) waves that can be transmitted over the air to another device. Patch antennas can also convert RF waves into electrical signals. In some instances, patch antennas must be designed to operate over a broad range of frequencies, which can impact the axial ratio of a radiation pattern emitted by the patch antennas.

SUMMARY

Aspects and advantages of embodiments of the present disclosure will be set forth in part in the following description, or may be learned from the description, or may be learned through practice of the embodiments.

One example aspect of the present disclosure is directed to a patch antenna array system. The patch antenna array system can include a plurality of patch antennas. The plurality of patch antennas can be oriented with respect to each other to provide a nearly symmetric radiation pattern over a range of frequencies, such as from 1500 Megahertz (MHz) to 1700 MHz. The patch antenna array system can include a sequential phase feed network that is in communication with the plurality of patch antennas. The sequential phase feed network can be configured to provide a radio frequency (RF) signal to each patch antenna of the plurality of patch antennas such that the patch antenna array system has an axial ratio of less than 1 decibel (dB) over the range of frequencies.

Another example aspect of the present disclosure is directed to a patch antenna array system having a plurality of patch antennas. The patch antenna array system further includes a sequential phase feed network. The sequential phase feed network is configured to provide a RF signal to each of the plurality of patch antennas. The sequential phase feed network includes a first annular portion configured to receive the RF signal from a RF source. The sequential phase feed network further includes a second annular portion. The second annular portion is in electrical communication with the first annular portion via a first leg extending from the first annular portion. The sequential phase feed network further includes a third annular portion. The third annular portion is in electrical communication with the first annular portion via a second leg extending from the first annular portion.

These and other features, aspects and advantages of various embodiments will become better understood with reference to the following description and appended claims. The accompanying drawings, which are incorporated in and constitute a part of this specification, illustrate embodiments of the present disclosure and, together with the description, serve to explain the related principles.

BRIEF DESCRIPTION OF THE DRAWINGS

Detailed discussion of embodiments directed to one of ordinary skill in the art are set forth in the specification, which refers to the appended figures, in which.

DETAILED DESCRIPTION

Figure 1:
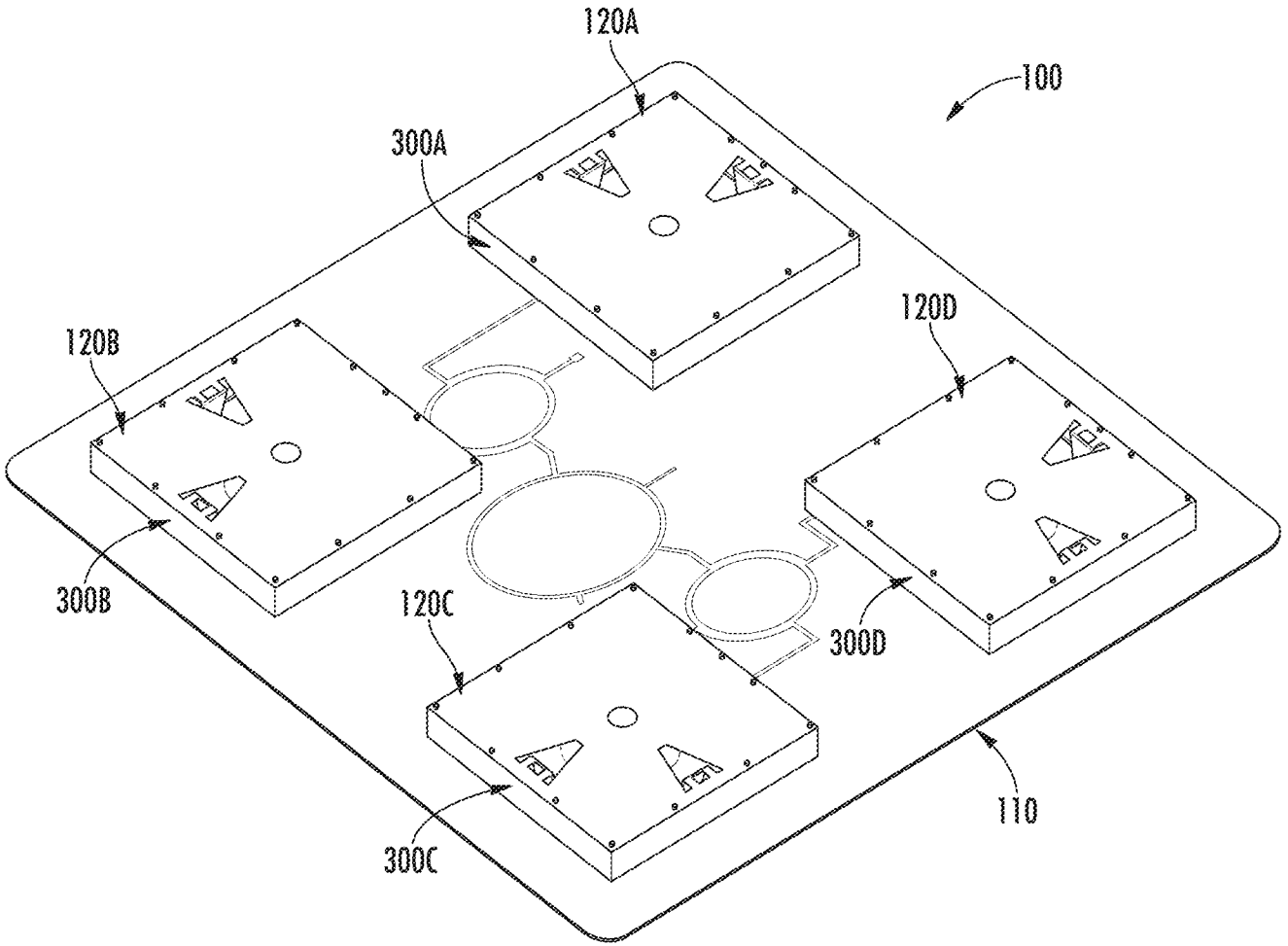
FIG. 1 depicts a perspective view of a patch antenna array system according to example embodiments of the present disclosure.

Reference now will be made in detail to embodiments, one or more examples of which are illustrated in the drawings. Each example is provided by way of explanation of the embodiments, not limitation of the present disclosure. In fact, it will be apparent to those skilled in the art that various modifications and variations can be made to the embodiments without departing from the scope or spirit of the present disclosure. For instance, features illustrated or described as part of one embodiment can be used with another embodiment to yield a still further embodiment. Thus, it is intended that aspects of the present disclosure cover such modifications and variations.

Example aspects of the present disclosure are directed to a patch antenna array system. The patch antenna array system can include a plurality of patch antennas. The plurality of patch antennas can, in some implementations, be oriented with respect to each other to provide a nearly symmetric radiation pattern over a range of frequencies, such as from 1500 Megahertz (MHz) to 1700 MHz.

In some implementations, the plurality of patch antennas can include a first patch antenna, a second patch antenna, a third patch antenna, and a fourth patch antenna. The second patch antenna can be oriented so that the second patch antenna is rotated about ninety degrees (90°) relative to the first patch antenna. The third patch antenna can be oriented so that the third patch antenna is rotated about one hundred and eighty degrees (180°) relative to the first patch antenna. The fourth patch antenna can be oriented so that the fourth patch antenna is rotated about two hundred and seventy degrees (270°) relative to the first patch antenna. In this manner, the antennas can be oriented with respect to each to provide the nearly symmetric radiation pattern over the range of frequencies. It should be appreciated, however, that the antennas can be rotated relative to each other by any suitable amount. For example, the second antenna can be rotated more than ninety degrees relative to the first antenna. Alternatively, the second antenna can be rotated less than ninety degrees relative to the first antenna.

The patch antenna array system can include a sequential phase feed network. The sequential phase feed network can be in communication with the plurality of patch antennas. In this manner, the sequential phase feed network can provide a RF signal to each of the plurality of patch antennas. In some implementations, the sequential phase feed network can include a plurality of annular portions. More specifically, the plurality of annular portions can be oriented with respect to each other such that the radiation pattern provided by the plurality of patch antennas has an axial ratio of less than 1 decibel over the range of frequencies.

The patch antenna array system according to the present disclosure has numerous technical benefits. For instance, the patch antennas are fed by two feed points of a sequential phase feed network that are orthogonal to one another and have about a ninety degree phase difference. In addition, the patch antennas are rotated about ninety degrees relative to one another. In this manner, the patch antenna array system of the present disclosure provides a nearly symmetric radiation pattern over the range of frequencies. Furthermore, the sequential phase feed network is configured such that the axial ratio associated with the nearly symmetric radiation pattern is less than 1 decibel (dB) across the range of frequencies.

As used herein, use of the term "nearly symmetric radiation pattern" means perfectly symmetric as well as at least 80% overlap when folded across an axis of propagation. As used herein, use of the term "axial ratio" refers to a ratio between minor and major axes of a radiation pattern provided by patch antenna array system according to the present disclosure. As used herein, use of the term "about" or "nearly" in conjunction with a numerical value is intended to refer to within ten percent (10%) of the stated numerical value.

Figure 2:
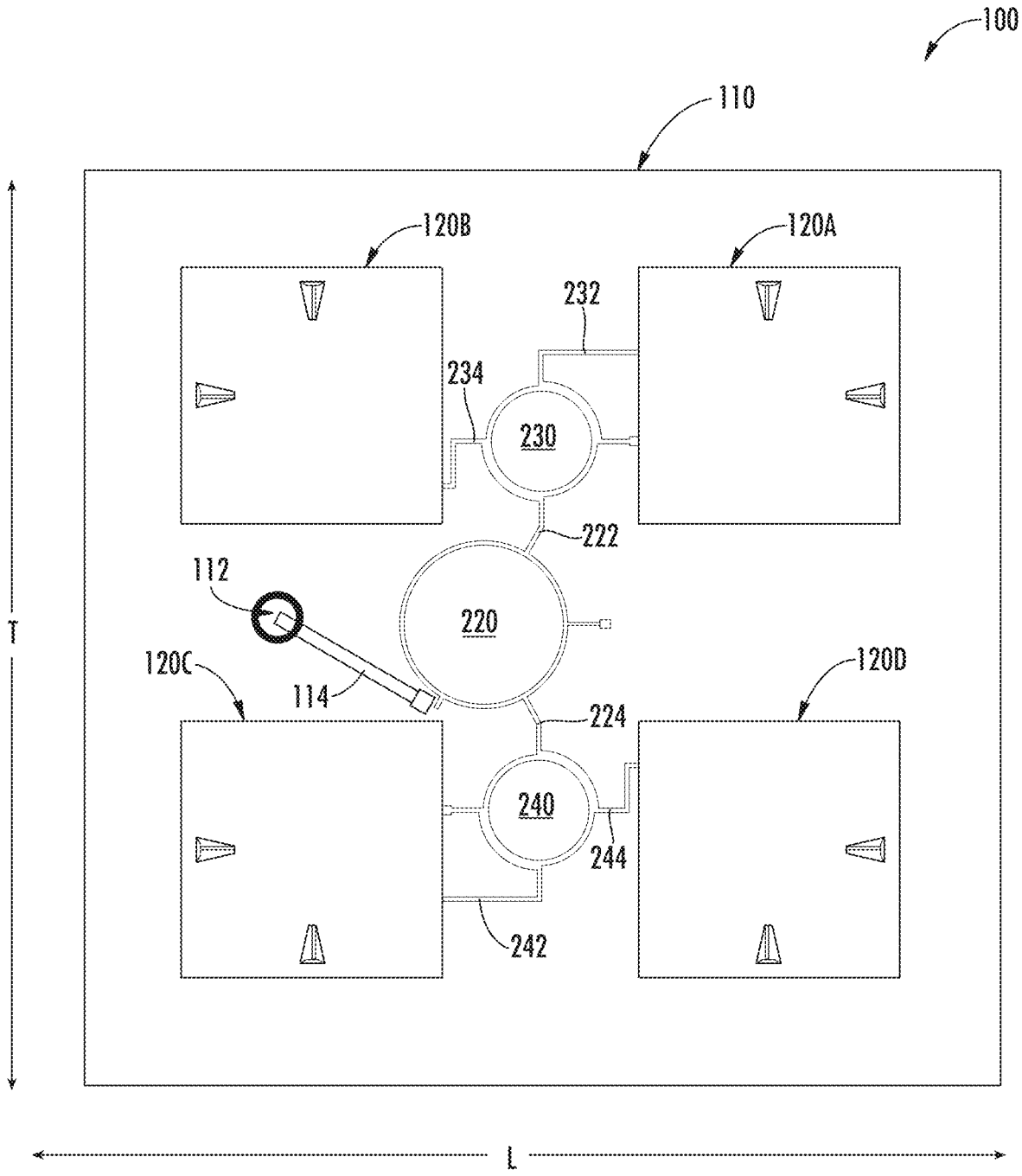
FIG. 2 depicts a top view of a patch antenna array system according to example embodiments of the present disclosure.
Figure 3:
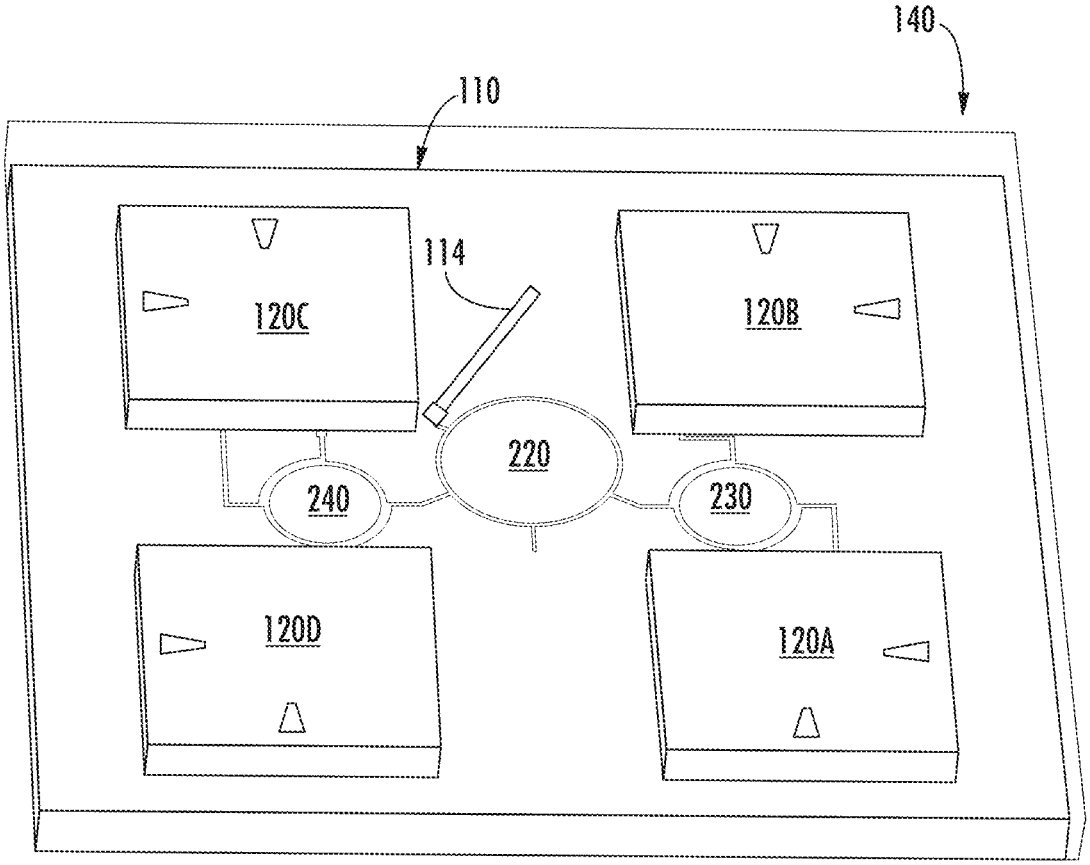
FIG. 3 depicts another perspective view of a patch antenna array according to example embodiments of the present disclosure.

Referring now to the FIGS., FIGS. 1-3 depict a patch antenna array system 100 according to example embodiments of the present disclosure. As shown, the patch antenna array system 100 can include a circuit board 110 that defines a lateral direction L and a transverse direction T that is orthogonal to lateral direction L. In some implementations, the circuit board 110 can be configured to accommodate a first patch antenna 120A of the patch antenna array system 100, a second patch antenna 120B of the patch antenna array system 100, a third patch antenna 120C of the patch antenna array system 100, and a fourth patch antenna 120D of the patch antenna array system 100.

It should be appreciated that the circuit board 110 can be formed from any suitable material. For instance, in some implementations, the circuit board 110 can be comprised of Rogers kappa 438. It also should be appreciated that the patch antenna array system 100 can include more or fewer patch antennas 120A-D. In addition, it should be appreciated that the patch antennas 120A-D can have any suitable shape. For instance, in some implementations, the patch antennas 120A-D can have a square shape. As will be discussed below in more detail, the patch antenna 120A-D can be oriented with respect to each other to provide a nearly symmetric radiation pattern (e.g., circular polarization pattern) over a range of frequencies.

In some implementations, the patch antennas 120A-D can be rotated relative to each other. For instance, the second patch antenna 120B can be rotated about ninety degrees relative to the first patch antenna 120A, the third patch antenna 120C can be rotated about one hundred and eighty degrees relative to the first patch antenna 120A, and the fourth patch antenna 120D can be rotated about two hundred and seventy degrees relative to the first patch antenna 120A. In this manner, the patch antennas 120A-D can be oriented relative to one another to provide the nearly symmetric radiation pattern over the range of frequencies.

In some implementations, the patch antenna array system 100 can include a housing 140 configured to accommodate the circuit board 110 and the plurality of patch antennas 120A-D. In this manner, both the circuit board 110 and the plurality of patch antennas 120A-D can avoid exposure to an environment (e.g., outdoors) in which the patch antenna array system 100 is disposed. It should be appreciated that the housing 140 can be formed from any suitable material. For instance, in some implementations, the housing 140 can be formed, at least in part, from polyurethane.

Figure 4:
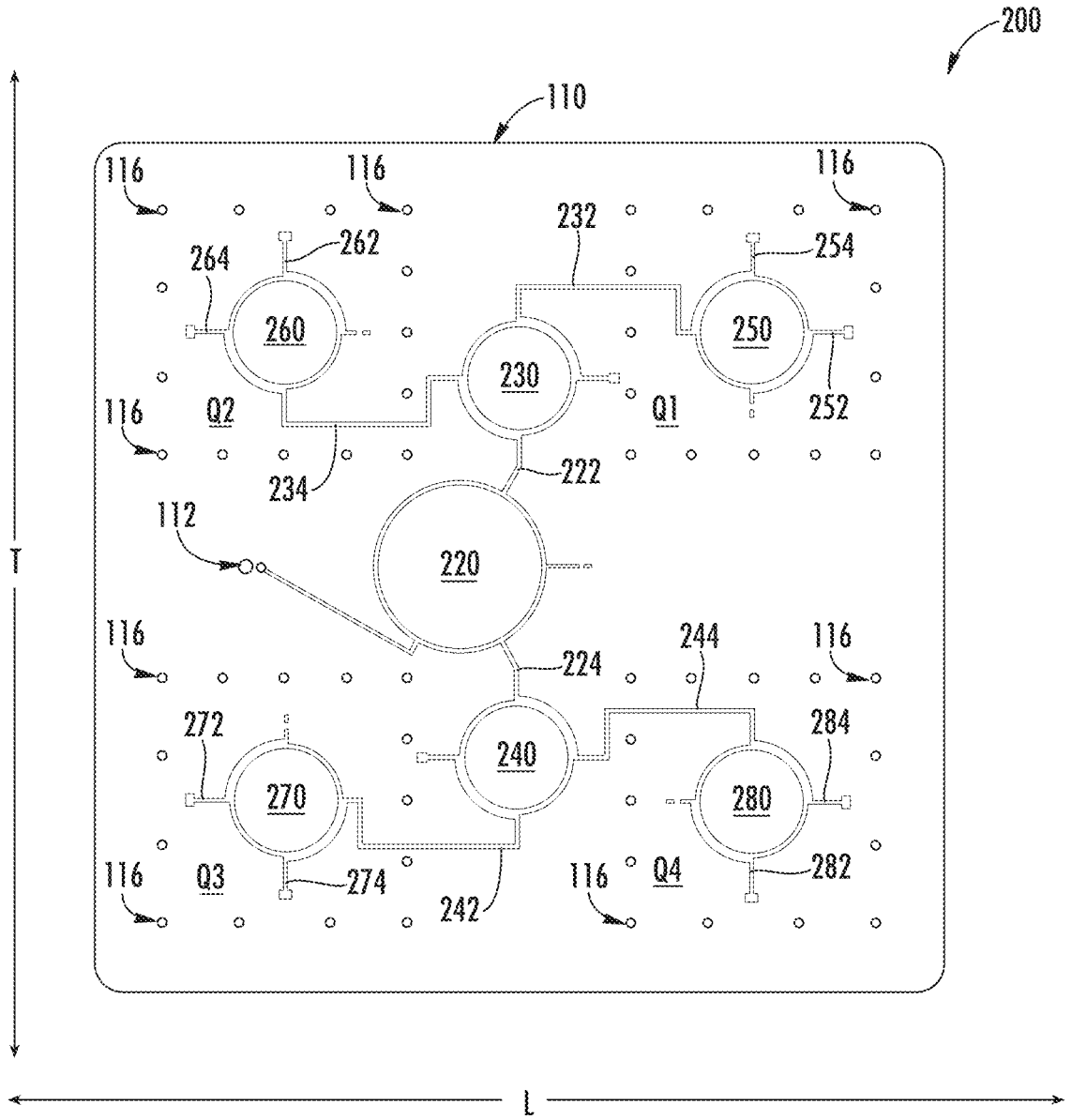
FIG. 4 depicts a sequential phase feed network of a patch antenna array according to example embodiments of the present disclosure.

Referring now to FIG. 4, the patch antenna array system 100 can include a sequential phase feed network 200 defined (e.g., etched) in the circuit board 110. In some implementations, the sequential phase feed network 200 can include a first annular portion 220, a second annular portion 230, a third annular portion 240, a fourth annular portion 250, a fifth annular portion 260, a sixth annular portion 270, and a seventh annular portion 280. It should be appreciated, however, that the sequential phase feed network 200 can include more or fewer annular portions. As will be discussed below in more detail, the annular portions 220-280 can be oriented with respect to one another on the circuit board 110 such that an axial ratio associated with the nearly symmetric radiation pattern emitted by the patch antennas 120A-D is less than 1 decibel (dB).

In some implementations, the first annular portion 220 can be positioned at a center of the circuit board 110. As shown, the first annular portion 220 can be coupled to a power source via a conductor 114 that extends through an aperture 112 defined in the circuit board 110. In this manner, the first annular portion 220 can receive one or more signals (e.g., RF signal) from the power source.

In some implementations, the second annular portion 230 can be positioned adjacent the first annular portion 220. As shown, the second annular portion 230 can be in electrical communication with the first annular portion 220 via a first leg 222 of the sequential phase feed network 200. More specifically, the first leg 222 can extend from the first annular portion 220 to the second annular portion 230. In some implementations, the third annular portion 240 can be positioned adjacent the first annular portion 220. As shown, the third annular portion 240 can be in electrical communication with the first annular portion 220 via a second leg 224 of the sequential phase feed network 200. More specifically, the second leg 224 can extend from the first annular portion 220 to the third annular portion 240. In some implementations, the first, second, and third annular portions 220, 230, 240 of the sequential phase feed network 200 can be aligned along the transverse direction T such that the first annular portion 220 is positioned between the second annular portion 230 and the third annular portion 240.

In some implementations, the fourth annular portion 250 can be positioned within a first quadrant Q1 of the circuit board 110. As shown, the circuit board 110 can define a plurality of apertures 116 arranged as show to define a perimeter of the first quadrant Q1. As shown, the fourth annular portion 250 can be in electrical communication with the second annular portion 230 via a third leg 232 of the sequential phase feed network 200. More specifically, the third leg 232 can extend from the second annular portion 230 to the fourth annular portion 250.

In some implementations, the fifth annular portion 260 can be positioned within a second quadrant Q2 of the circuit board 110 that is defined, at least in part, by a plurality of apertures 116 extending through the circuit board 110. As shown, the second annular portion 230 can be positioned between the first quadrant Q1 and the second quadrant Q2 along the lateral direction L. In some implementations, the fifth annular portion 260 can be in electrical communication with the second annular portion 230 via a fourth leg 234 of the sequential phase feed network 200. More specifically, the fourth leg 234 can extend from the second annular portion 230 to the fifth annular portion 260.

In some implementations, the sixth annular portion 270 can be positioned with a third quadrant Q3 of the circuit board 110 that is defined, at least in part, by the apertures 116 extending through the circuit board 110. As shown, the first annular portion 220 can be positioned between second quadrant Q2 and the third quadrant Q3 along the transverse direction T. In some implementations, the sixth annular portion 270 can be in electrical communication with the third annular portion 240 via a fifth leg 242 of the sequential phase feed network 200. More specifically, the fifth leg 242 can extend from the third annular portion 240 to the sixth annular portion 270.

In some implementations, the seventh annular portion 280 can be positioned within a fourth quadrant Q4 of the circuit board 110 that is defined, at least in part, by the apertures 116 extending through the circuit board 110. As shown, the first annular portion 220 can be positioned between the first quadrant Q1 and the fourth quadrant Q4 along the transverse direction T. Additionally, the third annular portion 240 can be positioned between the third quadrant Q3 and the fourth quadrant Q4 along the lateral direction L. In some implementations, the seventh annular portion 280 can be in electrical communication with the third annular portion 240 via a sixth leg 244 of the sequential phase feed network 200. More specifically, the sixth leg 244 can extend from the third annular portion 240 to the seventh annular portion 280.

In some implementations, the sequential phase feed network 200 can be configured to provide a first RF signal to the first patch antenna 120A, a second RF signal to the second patch antenna 120B, a third RF signal to the third patch antenna 120C, and a fourth RF signal to the fourth patch antenna 120D. More specifically, the RF signal (e.g., first, second, third, and fourth) provided to each of the patch antennas 120A-D can be out-of-phase with respect to each other. For instance, the second RF signal, the third RF signal, and the fourth RF signal can each be out-of-phase relative to the first RF signal. In some implementations, the second RF signal can be about 90 degrees out-of-phase relative to the first RF signal, the third RF signal can be about one hundred and eighty degrees out-of-phase relative to the first RF signal, and the fourth RF signal can be about two hundred and seventy degrees out-of-phase relative to the first RF signal.

Figure 5:
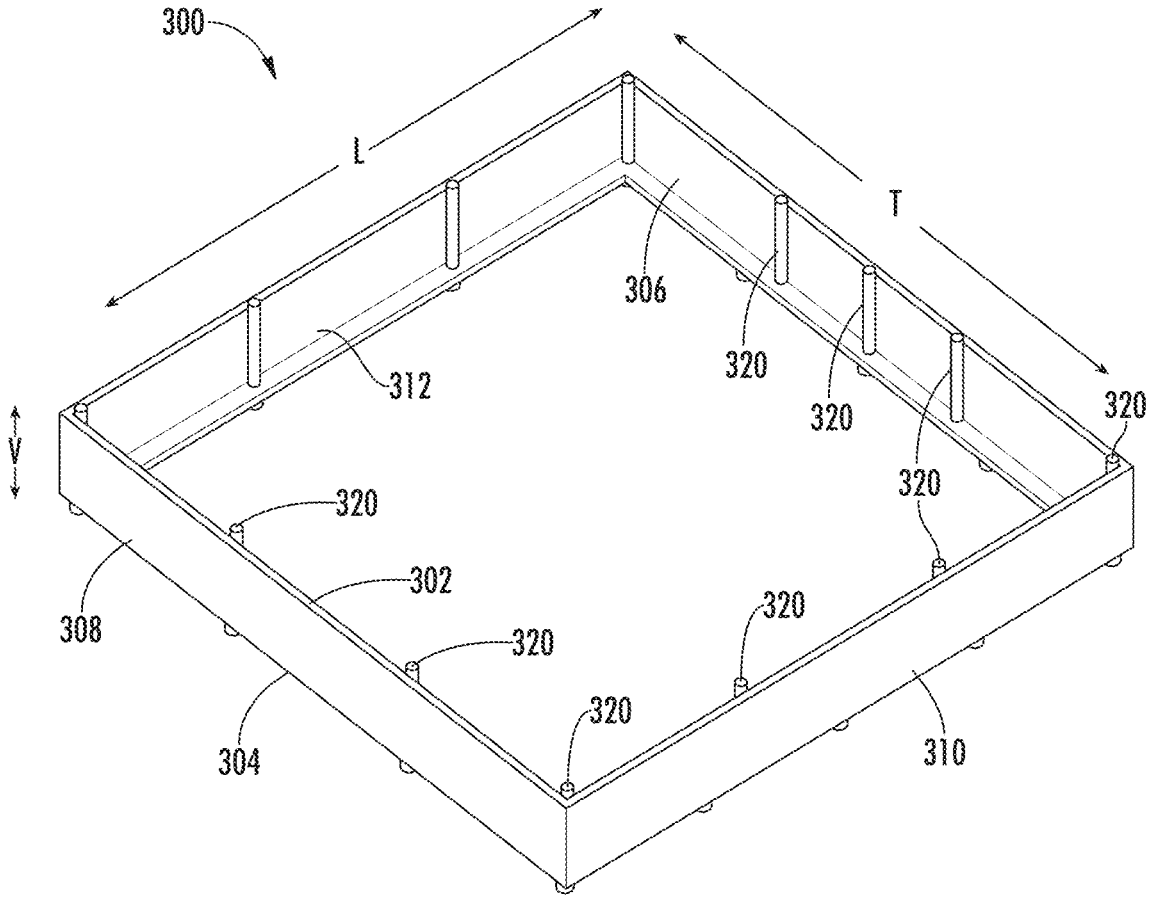
FIG. 5 depicts a spacer of a patch antenna array system according to example embodiments of the present disclosure.

Referring now to FIG. 5, the patch antenna array system 100 can include a spacer 300. As shown, the spacer 300 defines a vertical direction V, a lateral direction L orthogonal to the vertical direction V, and a transverse direction T orthogonal to both the vertical direction V and the lateral direction L. The spacer 300 can extend along the vertical direction V between a top portion 302 of the spacer 300 and a bottom portion 304 of the spacer 300. The spacer 300 can include various sides. For instances, the spacer can include a first side 306 extending along the transverse direction T and a second side 308 spaced apart from the first side 306 along the lateral direction L and extending along the transverse direction T. Additionally, the spacer 300 can include a third side 310 extending along the lateral direction L between the first side 306 and the second side 308. As shown, the spacer 300 can further include a fourth side 312 spaced apart from the third side 310 along the transverse direction T and extending between the first side 306 and the second side 308 along the lateral direction L.

In some implementations, the spacer 300 can include a plurality of pegs 320. For instances, each side 306, 308, 310, 312 of the spacer 300 can include pegs 320. As shown, the first side 306 of the spacer 300 and the second side 308 of the spacer 300 can each include pegs 320 spaced apart from one another along the transverse direction T. Alternatively or additionally, the third side 310 of the spacer 300 and the fourth side 312 of the spacer 300 can each include pegs 320 spaced apart from one another along the lateral direction L. In this manner, the spacer 300 can be secured to the circuit board 110 (FIG. 4) via the one or more pegs 320. More specifically, the one or more pegs 320 can be received within a corresponding aperture of the plurality of apertures 116 (FIG. 4) defined by the circuit board 110 (FIG. 4). As will be discussed below in more detail, each of the plurality of patch antennas 120A-D can be secured to the circuit board 110 (FIG. 1) via the spacer 300.

Figure 6:
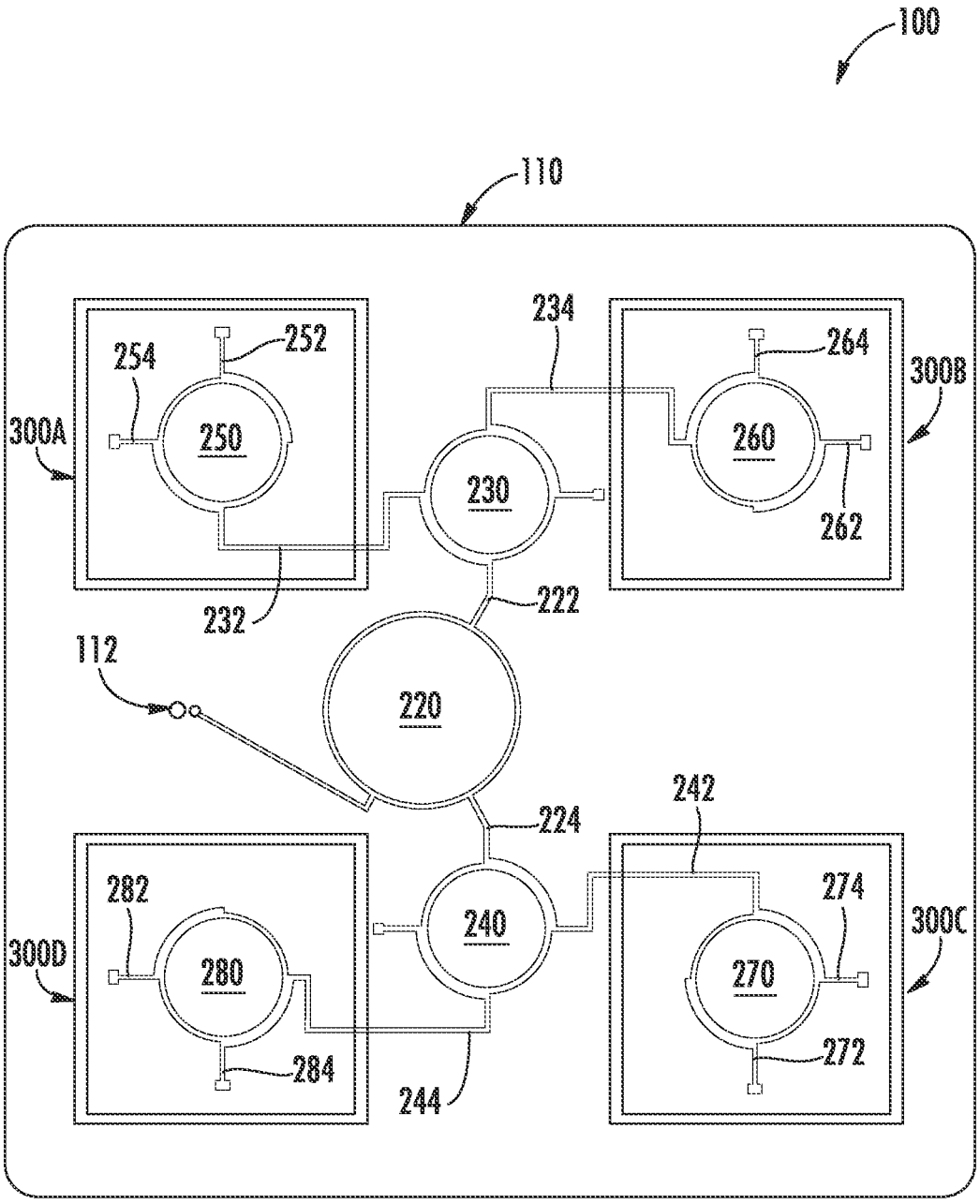
FIG. 6 depicts a plurality of spacers of a patch antenna array system mounted to a circuit board of the patch antenna array system according to example embodiments of the present disclosure.

Referring now to FIG. 6, the patch antenna array system 100 can include a first spacer 300A, a second spacer 300B, a third spacer 300C, and a fourth spacer 300D. The first spacer 300A can be secured to the circuit board 110 such that the fourth annular portion 250 of the sequential phase feed network 200 (FIG. 4) is positioned within a perimeter of the first spacer 300A. The second spacer 300B can be secured to the circuit board 110 such that the fifth annular portion 260 of the sequential phase feed network 200 is positioned within a perimeter of the second spacer 300B. The third spacer 300C can be secured to the circuit board 110 such that the sixth annular portion 270 of the sequential phase feed network 200 is positioned within a perimeter of the third spacer 300C. The fourth spacer 300D can be secured to the circuit board 110 such that the seventh annular portion 280 of the sequential phase feed network is positioned within a perimeter of the fourth spacer 300D.

Figure 7:
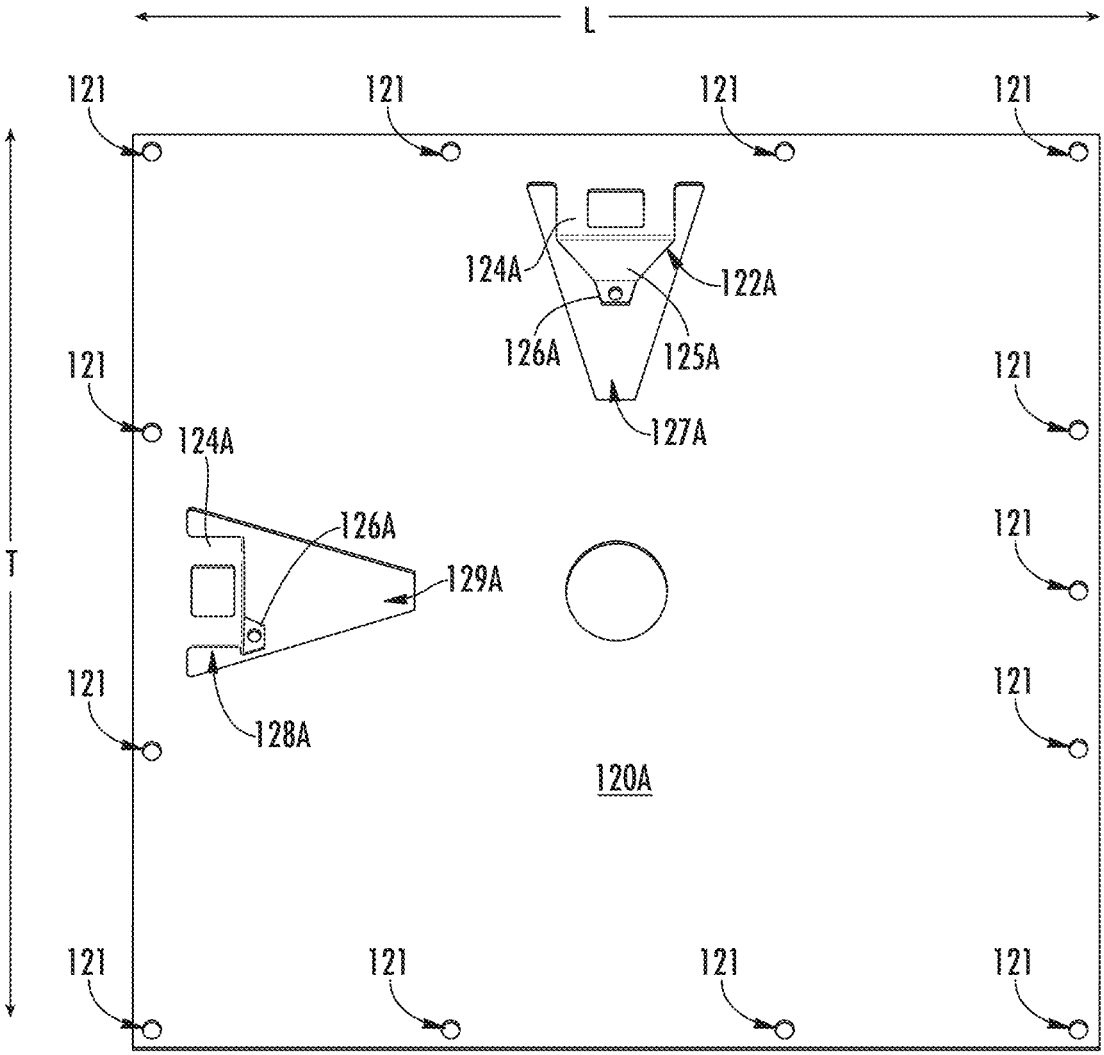
FIG. 7 depicts a top view of a patch antenna according to example embodiments of the present disclosure.
Figure 8:
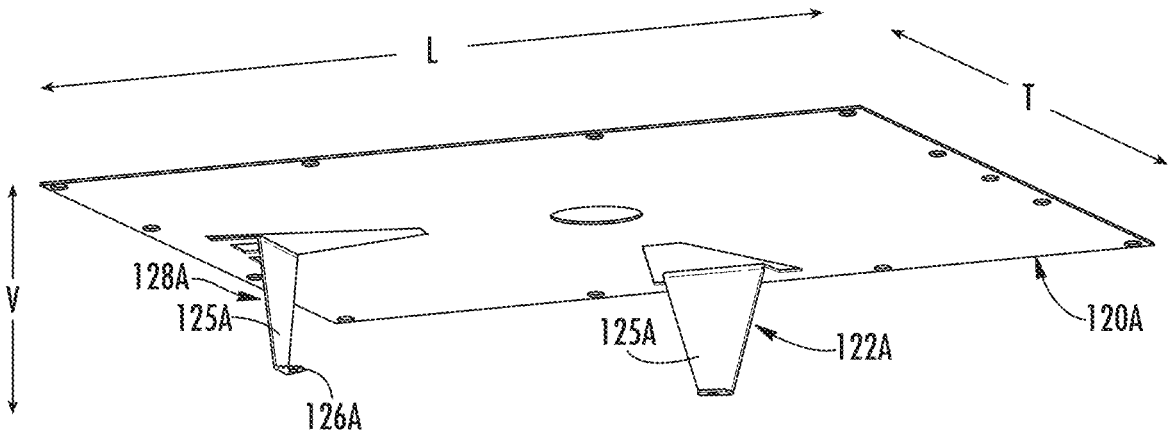
FIG. 8 depicts a bottom perspective view of a patch antenna according to example embodiments of the present disclosure.

Referring now to FIGS. 7 and 8 in combination, an example embodiment of the first patch antenna 120A is depicted according to example embodiments of the present disclosure. As shown, the first patch antenna 120A defines a vertical direction V, a lateral direction L orthogonal to the vertical direction V, and a transverse direction T orthogonal to both the vertical direction V and the lateral direction L. In some implementations, the first patch antenna can define a plurality of apertures 121. As shown, each aperture of the plurality of apertures 121 can accommodate a corresponding peg 320 (FIG. 5) associated with the first spacer 300A (FIG. 6). In this manner, the first patch antenna 120A can be secured to the first spacer 300A as shown in FIG. 2.

The first patch antenna 120A can include a first feed leg 122A. In some implementations, the first feed leg 122A can include a first portion 124A, a second portion 125A, and a third portion 126A. As shown, the first portion 124A of the first feed leg 122A can extend along the lateral direction L. More specifically, the first portion 124A of the first feed leg 122A can extend into a first aperture 127A defined by the first patch antenna 120A. As shown, the second portion 125A of the first feed leg 122A can extend from the first portion 124A of the first feed leg 122A along the vertical direction V.

In some implementations, the second portion 125A of the first feed leg 122A can be angled relative to the first portion 124A of the first feed leg 122A. For instance, the second portion 125A of the first feed leg 122A can be generally orthogonal relative to the first portion 124A of the first feed leg 122A. As shown, the third portion 126A of the first feed leg 122A can extend from the second portion 125A of the first feed leg 122A along the lateral direction L. In some implementations, the third portion 126A of the first feed leg 122A can be angled relative to the second portion 125A of the first feed leg 122A. For instance, the third portion 126A of the first feed leg 122A can be generally orthogonal relative to the second portion 125A of the first feed leg 122A. Additionally, the third portion 126A of the first feed leg 122A can be parallel with the first portion 124A of the first feed leg 122A.

In some implementations, the first patch antenna 120A can include a second feed leg 128A that is rotated relative to the first feed leg 122A. For instance, the second feed leg 128A can be rotated about ninety degrees relative to the first feed leg 122A. It should be appreciated that the second feed leg 128A can be rotated relative to the first feed leg 122A by any suitable amount. For instance, in some implementations, the second feed leg 128A can be rotated more than ninety degrees relative to the first feed leg 122A. In alternative implementations, the second feed leg 128A can be rotated less than ninety degrees relative to the first feed leg 122A.

In some implementations, the second feed leg 128A can include a first portion 124A, a second portion 125A, and a third portion 126A. As shown, the first portion 124A of the second feed leg 128A can extend along the lateral direction L. More specifically, the first portion 124A of the second feed leg 128A can extend into a second aperture 129A defined by the first patch antenna 120A. As shown, the second portion 125A of the second feed leg 128A can extend from the first portion 124A of the second feed leg 128A along the vertical direction V.

In some implementations, the second portion 125A of the second feed leg 128A can be angled relative to the first portion 124A of the second feed leg 128A. For instance, the second portion 125A of the second feed leg 128A can be generally orthogonal relative to the first portion 124A of the second feed leg 128A. As shown, the third portion 126A of the second feed leg 128A can extend from the second portion 125A of the second feed leg 128A along the lateral direction L.

In some implementations, the third portion 126A of the second feed leg 128A can be angled relative to the second portion 125A of the second feed leg 128A. For instance, the third portion 126A of the second feed leg 128A can be generally orthogonal relative to the second portion 125A of the second feed leg 128A. Additionally, the third portion 126A of the second feed leg 128A can be parallel with the first portion 124A of the second feed leg 128A. As will be discussed below in more detail, at least one of the first feed leg 122A and the second feed leg 128A can be in electrical communication with the sequential phase feed network 200 (FIG. 3). In this manner, the first patch antenna 120A can, as discussed above, receive a RF signal from the sequential phase feed network 200.

It should be appreciated that the second patch antenna 120B, third patch antenna 120C, and fourth patch antenna 120D can be configured in a substantially similar manner. More specifically, each of the second patch antenna 120B, third patch antenna 120C, and fourth patch antenna 120D can be identical to the first patch antenna 120A.

Figure 9:
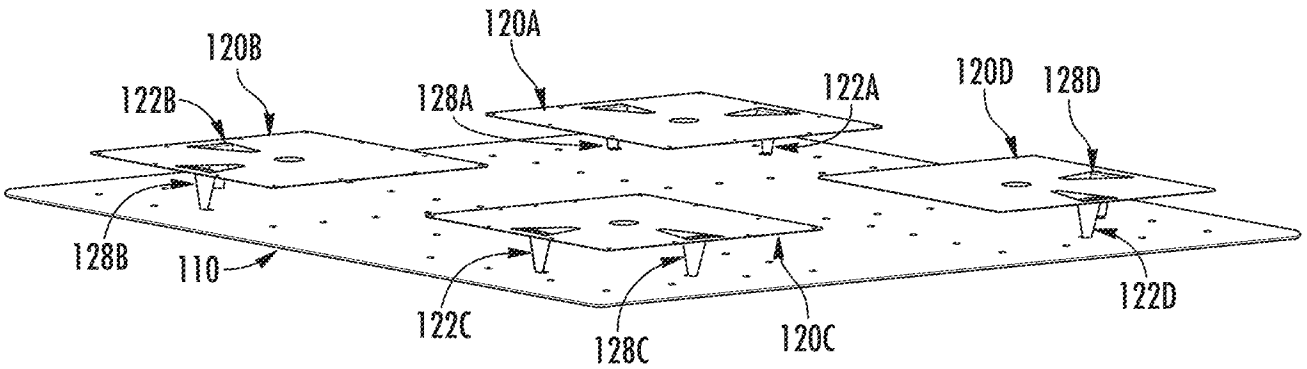
FIG. 9 depicts a plurality of patch antennas of a patch antenna array system mounted to a circuit board of the patch antenna array system according to example embodiments of the present disclosure.
Figure 10:
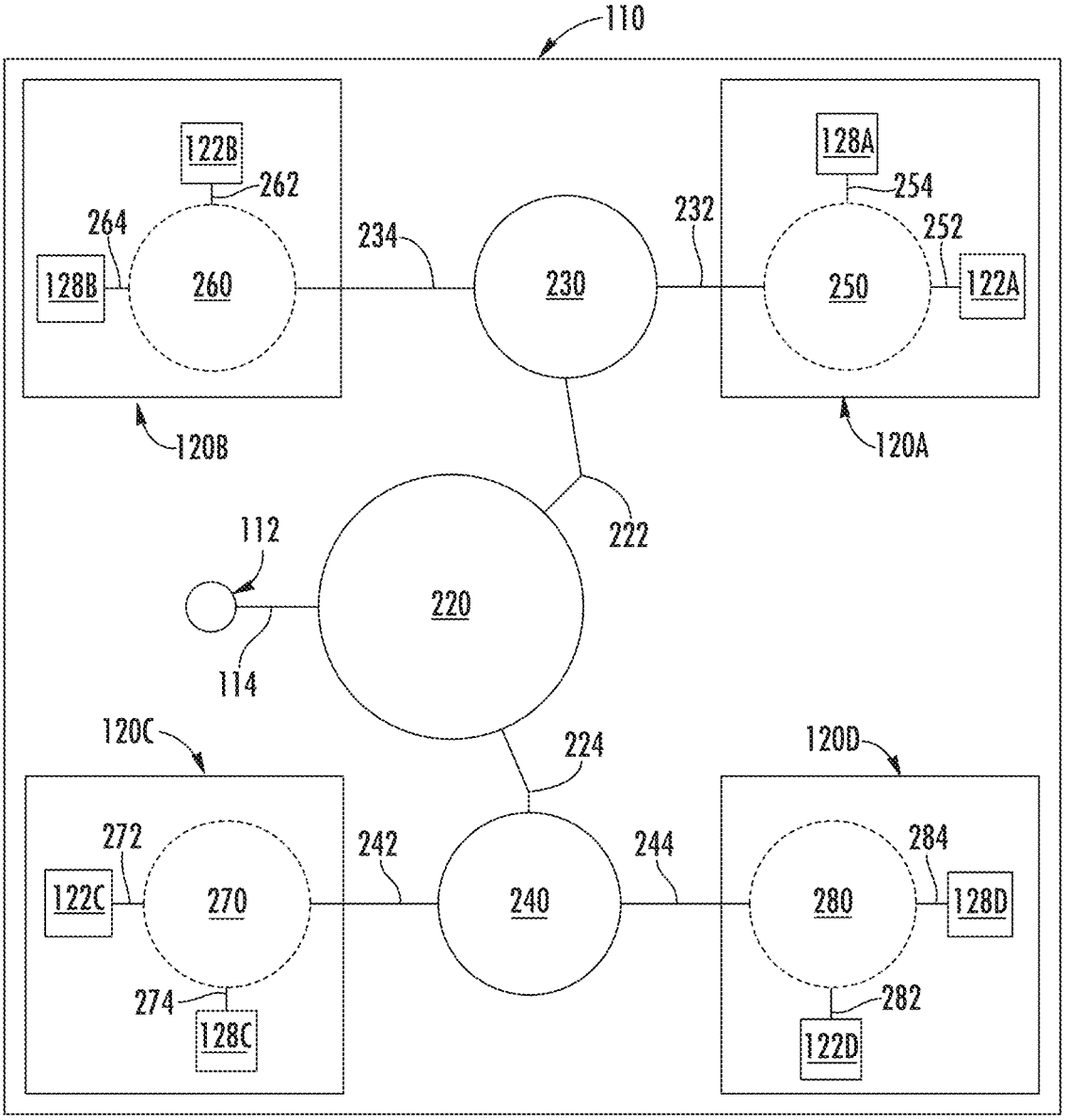
FIG. 10 depicts a block diagram of a patch antenna array system according to example embodiments of the present disclosure.

Referring now to FIGS. 9 and 10, the first patch antenna 120A can be in electrical communication with the fourth annular portion 250 of the sequential phase feed network 200. More specifically, the sequential phase feed network 200 can include a seventh leg 252 that extends from the fourth annular portion 250. When the first patch antenna 120A is secured to the first spacer 300A (FIG. 6), the first feed leg 122A of the first patch antenna 120A contacts the seventh leg 252 of the sequential phase feed network 200 such that the first feed leg 122A of the first patch antenna 120A is in electrical communication with the fourth annular portion 250. More specifically, the third portion 126A (FIG. 7) of the first feed leg 122A contacts the seventh leg 252. Furthermore, when the first feed leg 122A contacts the seventh leg 252, the first patch antenna 120A can receive a RF signal from the sequential phase feed network 200.

In some implementations, the sequential phase feed network 200 can include an eight leg 254 that extends from the fourth annular portion 250 and is spaced apart from the seventh leg 252 along a circumferential direction. More specifically, the eight leg 254 can be spaced apart from the seventh leg 252 such that an angle of about ninety degrees is defined therebetween. When the first patch antenna 120A is secured to the first spacer 300A (FIG. 6), the second feed leg 128A of the first patch antenna 120A contacts the eight leg 254 of the sequential phase feed network 200 such that the second feed leg 128A of the first patch antenna 120A is in electrical communication with the fourth annular portion 250. More specifically, the third portion 126A (FIG. 7) of the second feed leg 128A contacts the eight leg 254. Furthermore, when the second feed leg 128A contacts the eight leg 254, the first patch antenna 120A can receive a RF signal from the sequential phase feed network 200. In some implementations, the RF signal the first patch antenna 120A receives via the eight leg 254 of the sequential phase feed network 200 can be out-of-phase relative to the RF signal the first patch antenna 120A receives via the seventh leg 252 of the sequential phase feed network 200.

In some implementations, the second patch antenna 120B can be in electrical communication with the fifth annular portion 260 of the sequential phase feed network 200. More specifically, the sequential phase feed network 200 can include a ninth leg 262 that extends from the fifth annular portion 260. When the second patch antenna 120B is secured to the second spacer 300B (FIG. 6), the first feed leg 122B of the second patch antenna 120B contacts the ninth leg 262 of the sequential phase feed network 200 such that the first feed leg 122B of the second patch antenna 120B is in electrical communication with the fifth annular portion 260. More specifically, the third portion of the first feed leg 122B contacts the ninth leg 262. Furthermore, when the first feed leg 122B contacts the ninth leg 262, the second patch antenna 120B can receive a RF signal from the sequential phase feed network 200.

In some implementations, the sequential phase feed network 200 can include a tenth leg 264 that extends from the fifth annular portion 260 and is spaced apart from the ninth leg 262 along a circumferential direction. More specifically, the tenth leg 264 can be spaced apart from the ninth leg 262 such that an angle of about ninety degrees is defined therebetween. When the second patch antenna 120B is secured to the second spacer 300B (FIG. 6), the second feed leg 128B of the second patch antenna 120B contacts the tenth leg 264 of the sequential phase feed network 200 such that the second feed leg 128B of the second patch antenna 120B is in electrical communication with the fifth annular portion 260. More specifically, the third portion of the second feed leg 128B contacts the tenth leg 264. Furthermore, when the second feed leg 128B of the second patch antenna 120B contacts the tenth leg 264 of the sequential phase feed network 200, the second patch antenna 120B can receive a RF signal from the sequential phase feed network 200. In some implementations, the RF signal the second patch antenna 120B receives via the tenth leg 264 of the sequential phase feed network 200 can be out-of-phase relative to the RF signal the second patch antenna 120B receives via the ninth leg 262 of the sequential phase feed network 200.

In some implementations, the third patch antenna 120C can be in electrical communication with the sixth annular portion 270 of the sequential phase feed network 200. More specifically, the sequential phase feed network 200 can include an eleventh leg 272 that extends from the sixth annular portion 270. When the third patch antenna 120C is secured to the third spacer 300C (FIG. 6), the first feed leg 122C of the third patch antenna 120C contacts the eleventh leg 272 of the sequential phase feed network 200 such that the first feed leg 122C of the third patch antenna 120C is in electrical communication with the sixth annular portion 270. More specifically, the third portion of the first feed leg 122C contacts the eleventh leg 272. Furthermore, when the first feed leg 122C contacts the eleventh leg 272, the third patch antenna 120C can receive a RF signal from the sequential phase feed network 200.

In some implementations, the sequential phase feed network 200 can include a twelfth leg 274 that extends from the sixth annular portion 270 and is spaced apart from the eleventh leg 272 along a circumferential direction. More specifically, the twelfth leg 274 can be spaced apart from the eleventh leg 272 such that an angle of about ninety degrees is defined therebetween. When the third patch antenna 120C is secured to the third spacer 300C (FIG. 6), the second feed leg 128C of the third patch antenna 120C contacts the twelfth leg 274 of the sequential phase feed network 200 such that the second feed leg 128C of the third patch antenna 120C is in electrical communication with the sixth annular portion 270. More specifically, the third portion of the second feed leg 128C contact the twelfth leg 274. Furthermore, when the second feed leg 128C of the third patch antenna 120C contacts the twelfth leg 274 of the sequential phase feed network 200, the third patch antenna 120C can receive a RF signal from the sequential phase feed network 200. In some implementations, the RF signal the third patch antenna 120C receives via the twelfth leg 274 of the sequential phase feed network 200 can be out-of-phase relative to the RF signal the third patch antenna 120C receives via the eleventh leg 272 of the sequential phase feed network 200.

In some implementations, the fourth patch antenna 120D can be in electrical communication with the seventh annular portion 280 of the sequential phase feed network 200. More specifically, the sequential phase feed network 200 can include a thirteenth leg 282 that extends from the seventh annular portion 280. When the fourth patch antenna 120D is secured to the fourth spacer 300D (FIG. 6), the first feed leg 122D of the fourth patch antenna 120D contacts the thirteenth leg 282 of the sequential phase feed network 200 such that the first feed leg 122D of the fourth patch antenna 120D is in electrical communication with the seventh annular portion 280. More specifically, the third portion of the first feed leg 122D contacts the thirteenth leg 282. Furthermore, when the first feed leg 122D contacts the thirteenth leg 282, the fourth patch antenna 120D can receive a RF signal from the sequential phase feed network 200.

In some implementations, the sequential phase feed network 200 can include a fourteenth leg 284 that extends from the seventh annular portion 280 and is spaced apart from the thirteenth leg 282 along a circumferential direction. More specifically, the fourteenth leg 284 can be spaced apart from the thirteenth leg 282 such that an angle of about ninety degrees is defined therebetween. When the fourth patch antenna 120D is secured to the fourth spacer 300D (FIG. 5), the second feed leg 128D of the fourth patch antenna 120D contacts the fourteenth leg 284 of the sequential phase feed network 200 such that the second feed leg 128D of the fourth patch antenna 120D is in electrical communication with the seventh annular portion 280. More specifically, the third portion of the second feed leg 128D contact the fourteenth leg 284. Furthermore, when the second feed leg 128D of the fourth patch antenna 120D contacts the fourteenth leg 284 of the sequential phase feed network 200, the fourth patch antenna 120D can receive a RF signal from the sequential phase feed network 200. In some implementations, the RF signal the fourth patch antenna 120D receives via the fourteenth leg 284 of the sequential phase feed network 200 can be out-of-phase relative to the RF signal the fourth patch antenna 120D receives via the thirteenth leg 282 of the sequential phase feed network 200.

Figure 11:
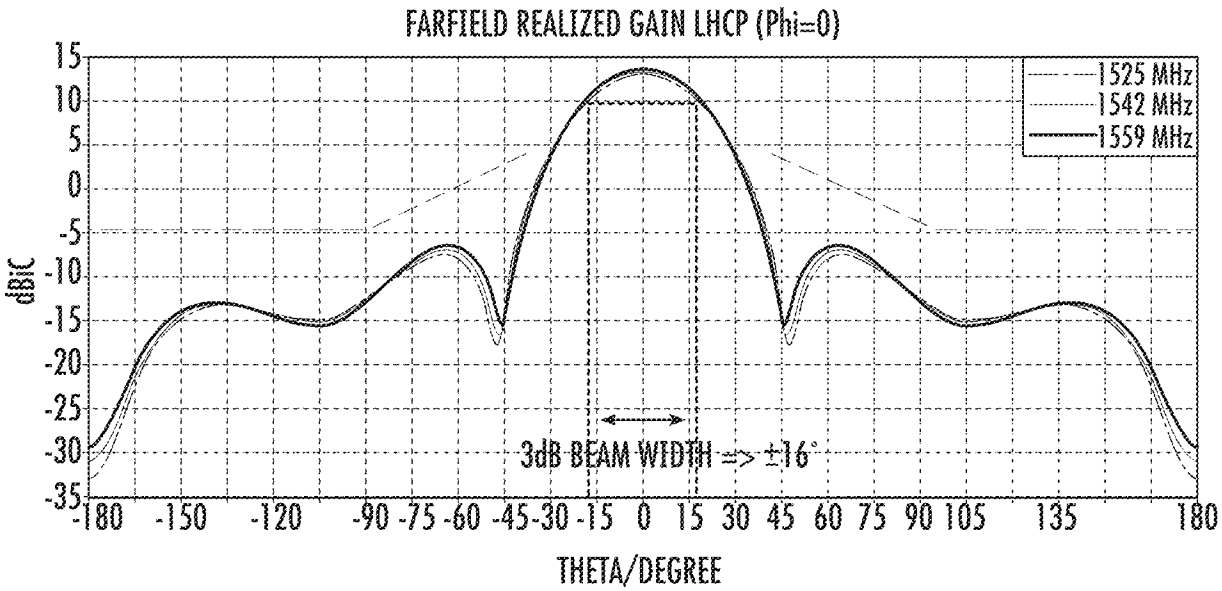
FIG. 11 depicts a graphical representation of a nearly symmetrical radiation pattern generated by a patch antenna array system according to example embodiments of the present disclosure.
Figure 12:
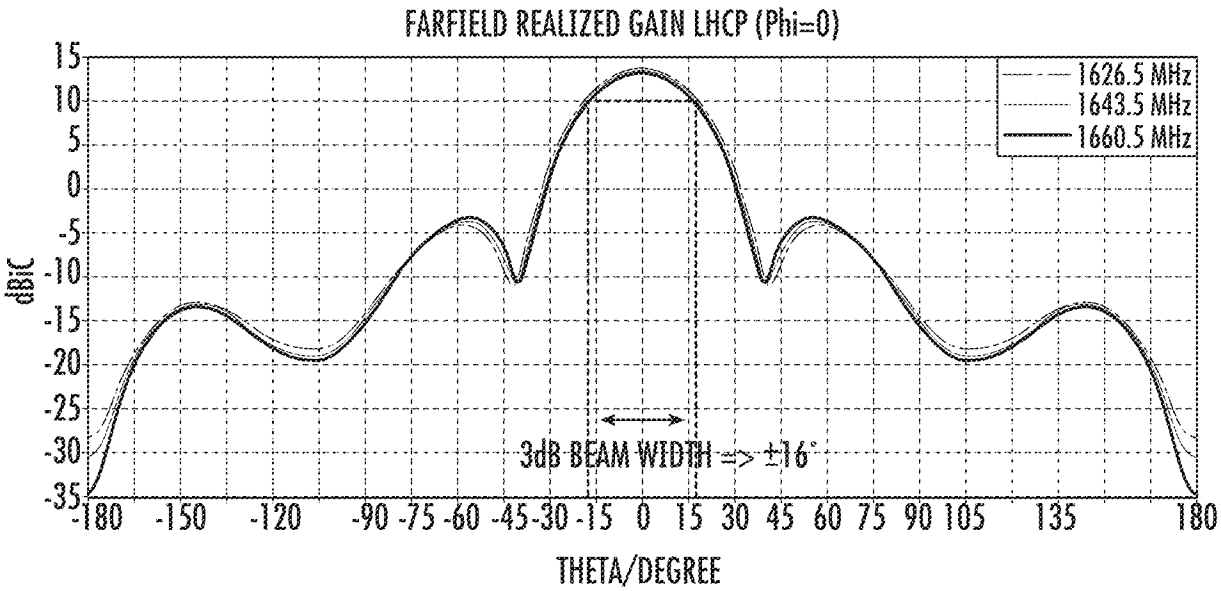
FIG. 12 depicts another graphical representation of a nearly symmetrical radiation pattern generated by a patch antenna array system according to example embodiments of the present disclosure.

Referring now to FIGS. 11 and 12, a graphical representation of the nearly symmetric radiation pattern of the patch antenna array system 100 is provided according to example embodiments of the present disclosure. As shown, the graphs in FIGS. 11 and 10 illustrate the gain (denoted along the vertical axis in decibels) of the nearly symmetric radiation pattern with as a function of phase angle (denoted along the horizontal axis in degrees). More specifically, the graph in FIG. 11 illustrates the gain (measured in decibels) of the nearly symmetric radiation pattern with respect to the phase angle (measured in degrees) over a first range of frequencies that spans from about 1525 Megahertz (MHz) to about 1559 MHz. The graph in FIG. 12 illustrates the gain of the nearly symmetric pattern with respect to the phase angle over a second range of frequencies that spans from about 1626 MHz to about 1660 MHz.

Figure 13:
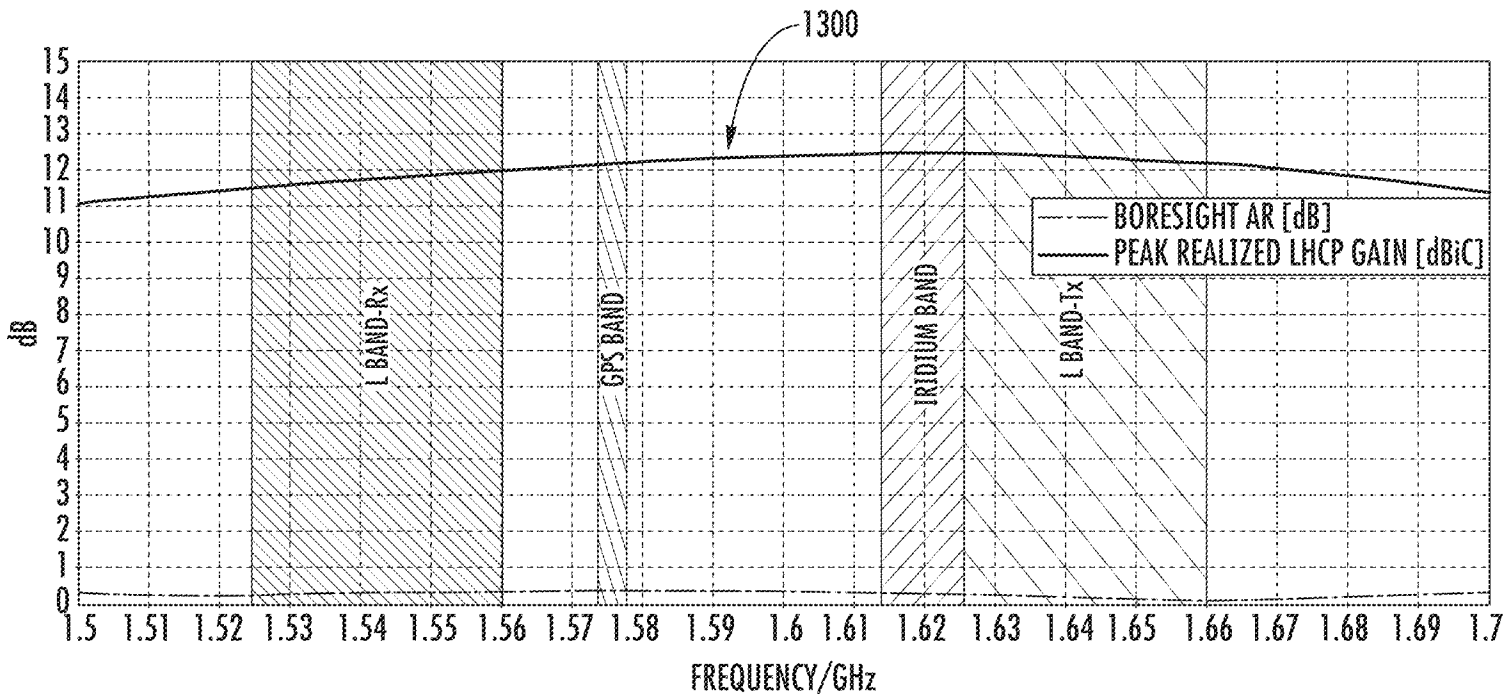
FIG. 13 depicts a graphical representation of a peak gain associated with a radiation pattern provided by a patch antenna array system according to example embodiments of the present disclosure.

Referring now to FIG. 13, a graphical representation of a gain associated with the nearly symmetric radiation pattern of the patch antenna array system 100 (FIG. 1) is provided according to the present disclosure. As shown, the graph in FIG. 13 illustrates the gain as a function of frequency (denoted along the horizontal axis in Gigahertz). As may be seen curve, 1300 illustrates the gain associated with the nearly symmetric radiation pattern over a range of frequencies spanning from 1.5 GHz to 1.7 GHz.

Figure 14:
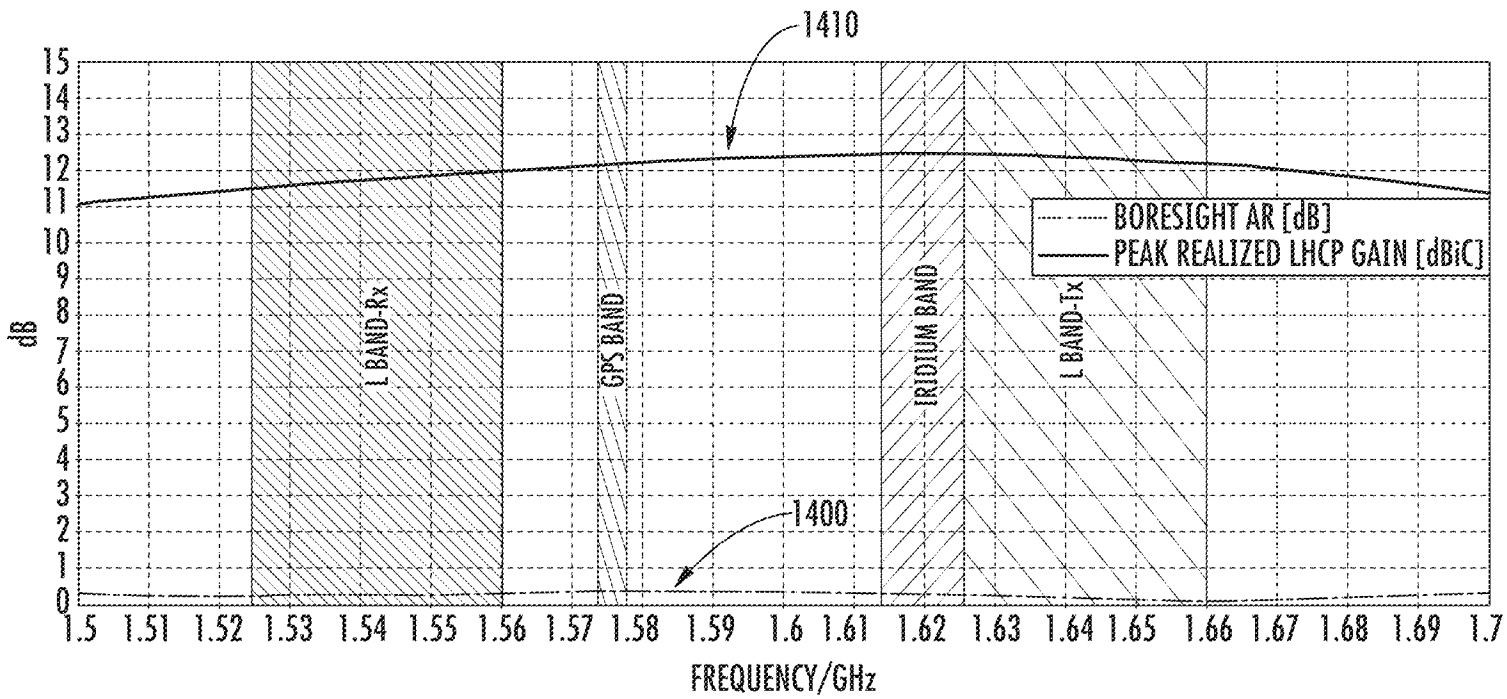
FIG. 14 depicts a graphical representation of an axial ratio associated with a radiation pattern provided by a patch antenna array system according to example embodiments of the present disclosure.

Referring now to FIG. 14, a graphical representation of the axial ratio associated with the nearly symmetric radiation pattern of the patch antenna array system 100 (FIG. 1) is provided according to example embodiments of the present disclosure. As shown, the graph in FIG. 14 illustrates the axial ratio as a function of frequency (denoted along the horizontal axis in Gigahertz). As may be seen, curve 1400 illustrates the axial illustrates the axial ratio of the nearly symmetric radiation pattern is less than 1 decibel across a range of frequencies that spans from 1.5 GHz to 1.7 GHz, which includes the GPS Band (e.g., about 1563 MHz to 1587 MHz) and the Iridium band (e.g., 1616 MHz to 1626 MHz).

Figure 15:
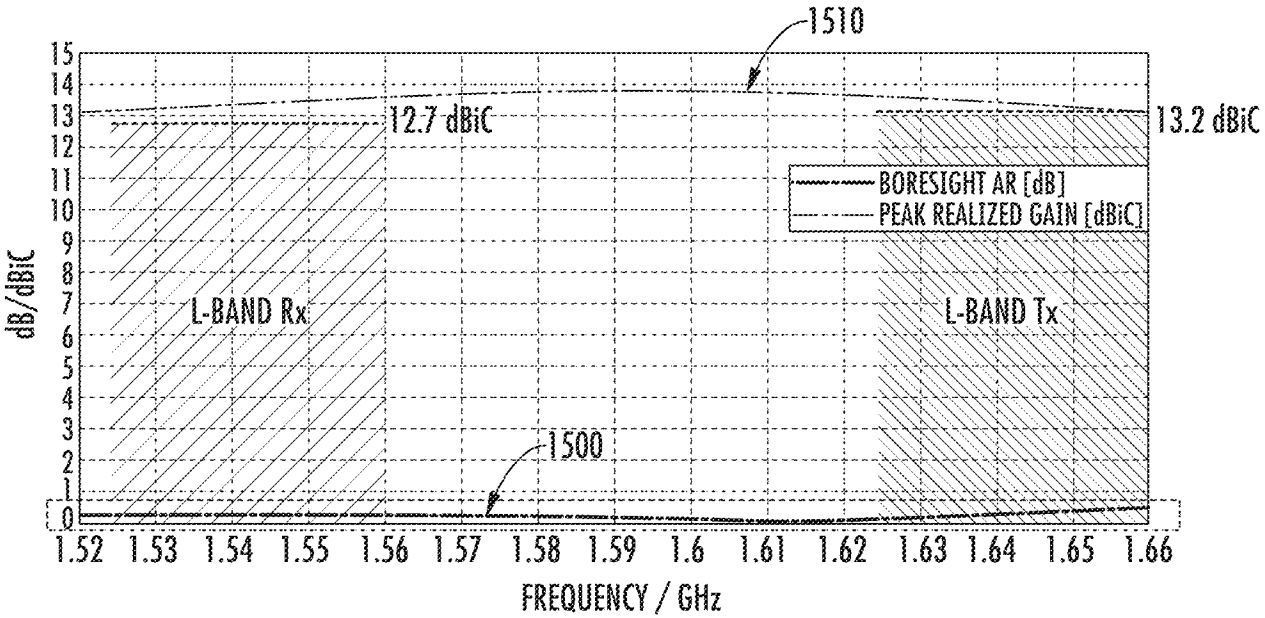
FIG. 15 depicts a graphical representation of an axial ratio associated with a radiation pattern provided by a patch antenna array system according to example embodiments of the present disclosure.

Referring now to FIG. 15, another graphical representation of the axial ratio associated with the nearly symmetric radiation pattern of the patch antenna array system 100 (FIG. 1) is provided according to example embodiments of the present disclosure. As may be seen, curve 1500 in FIG. 15 illustrates that the axial ratio is less than 1 decibel across a range of frequencies that includes a receive band and a transmit band. More specifically, the receive band spans from about 1525 MHz to about 1560 MHz, whereas the transmit band spans from about 1626 MHz to about 1660 MHz. Additionally, curve 1510 of FIG. 15 illustrates the peak gain and axial ratio of the nearly symmetric radiation pattern across the range of frequencies.

Figure 16:
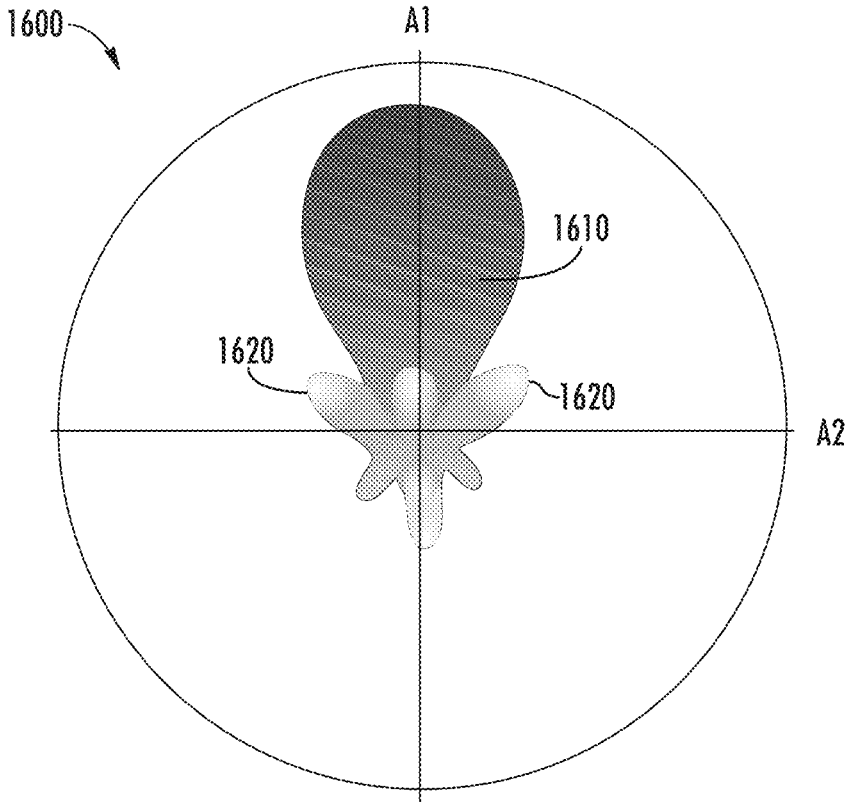
FIG. 16 depicts a nearly symmetric radiation pattern a patch antenna array system provides at a first frequency according to example embodiments of the present disclosure.
Figure 17:
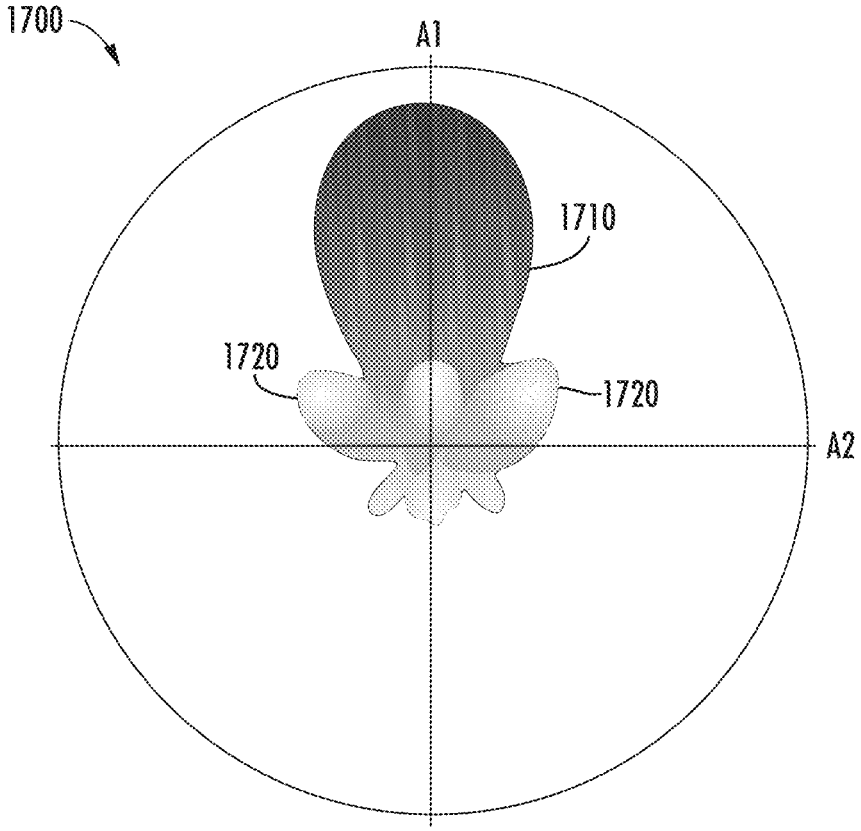
FIG. 17 depicts a nearly symmetric radiation pattern a patch antenna array system provides at a second frequency according to example embodiments of the present disclosure.

Referring now to FIGS. 16 and 17, a graphical representation of a nearly symmetric radiation pattern 1600, 1700 the patch antenna array system 100 (FIG. 1) provides at a first frequency (FIG. 16) and a second frequency (FIG. 17) that is different than the first frequency. In both FIGS. 16 and 17, the nearly symmetric radiation pattern 1600, 1700 extends along a first axis A1 and a second axis A2 that is orthogonal to the first axis A1. As may be seen, the nearly symmetric radiation pattern 1600, 1700 includes a main lobe 1610, 1710 and a plurality of sides lobes 1620, 1720. It should be appreciated that the axial ratio of the nearly symmetric radiation pattern 1600, 1700 is, as discussed above in more detail, less than 1 decibel.

Figure 18:
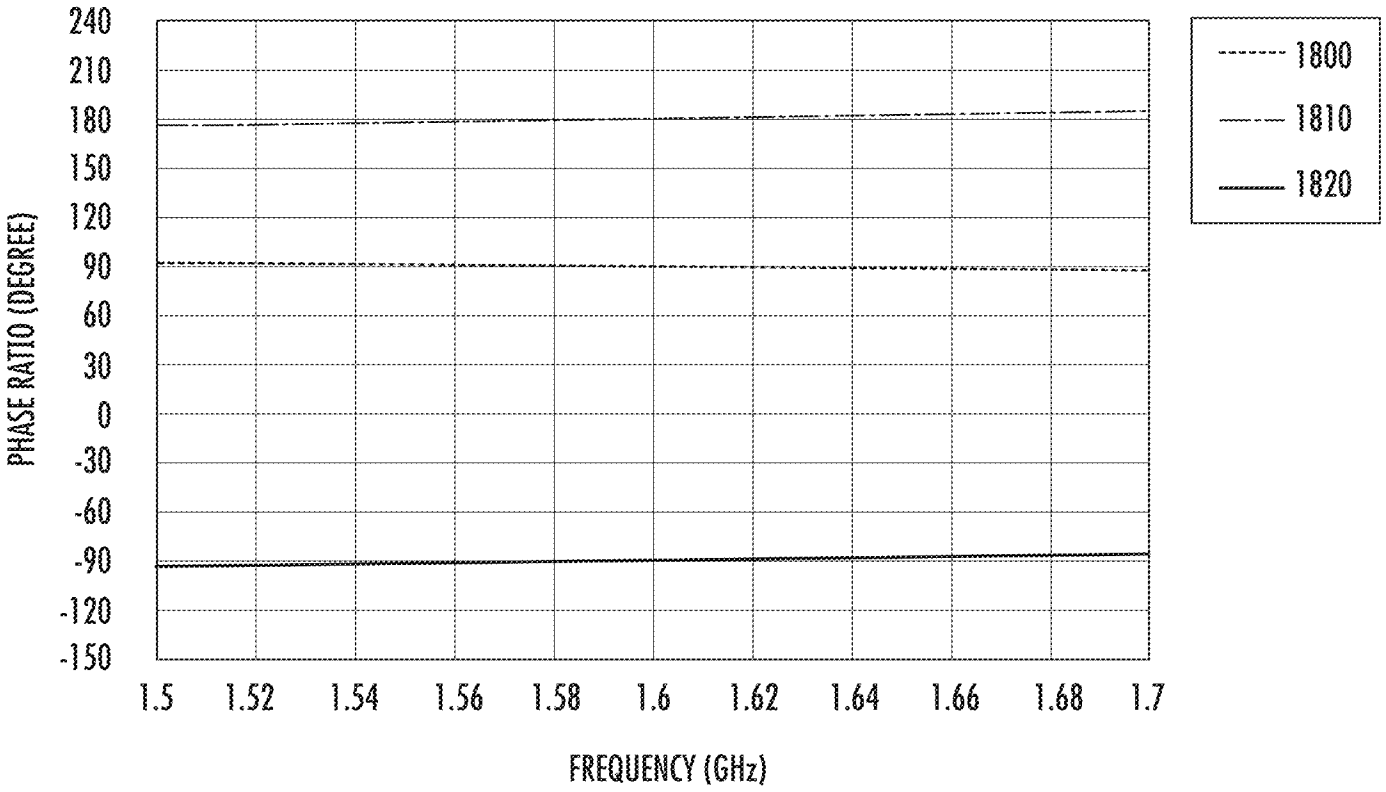
FIG. 18 depicts a graphical representation of the phase difference of a sequential phase feed network according to example embodiments of the present disclosure.

Referring now to FIG. 18, a graphical representation of the output signals of the second annular portion 230 (FIG. 4) and the third annular portion 240 (FIG. 4) of the sequential phase feed network 200 is provided over a range of frequencies (e.g., 1500 MHz to 1700 MHz) according to example embodiments of the present disclosure. Line 1800 depicts a phase difference between an output signal the second annular portion 230 provides to the second patch antenna 120B (FIG. 1) via the fourth leg 234 (FIG. 4) and an output signal the second annular portion 230 provides to the first patch antenna 120A (FIG. 1) via the third leg 232 (FIG. 4). More specifically, the line 1800 indicates the two output signals are out of phase by about 90 degrees. Line 1810 depicts a phase difference between an output signal the third annular portion 240 provides to third patch antenna 120C (FIG. 1) via the fifth leg 242 (FIG. 4) and the output signal the second annular portion 230 provides to the first patch antenna 120A via the third leg 232. More specifically, the line 1810 indicates the two output signals are out of phase by about 180 degrees. Line 1820 depicts a phase difference between an output signal the third annular portion 240 provides to the fourth patch antenna 120D (FIG. 1) via the sixth leg 244 (FIG. 4) and the output signal the second annular portion 230 provides to the first patch antenna 120A via the third leg 232. More specifically, the line 1820 depicts the two output signals are out of phase by about 270 degrees.

Figure 19:
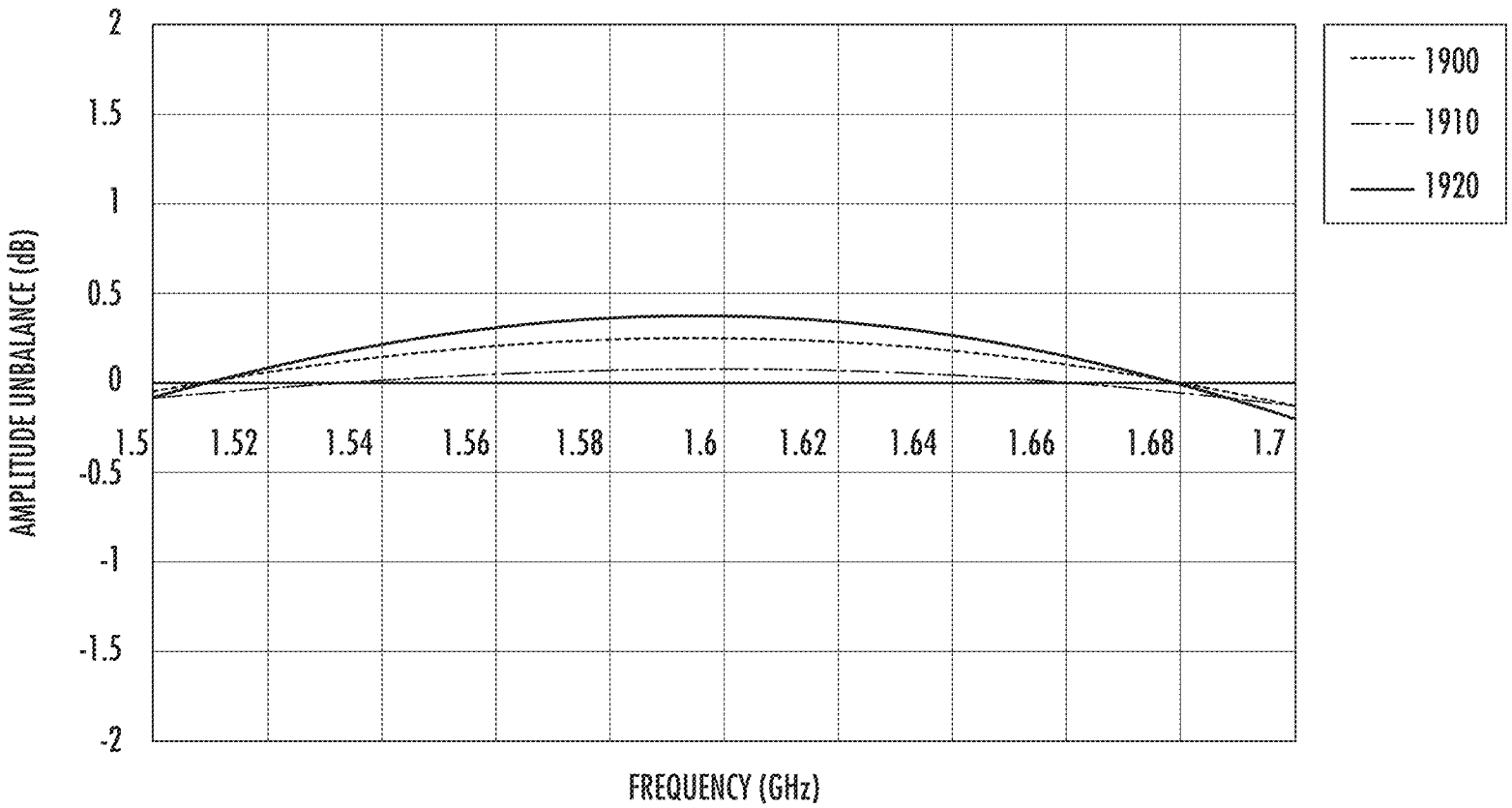
FIG. 19 depicts a graphical representation of an amplitude imbalance of a sequential phase feed network according to example embodiments of the present disclosure.

Referring now to FIG. 19, a graphical representation of amplitude imbalance of a sequential phase feed network over a range of frequencies (e.g., 1500 MHz to 1700 MHz) is provided according to example embodiments of the present disclosure. Curve 1900 depicts amplitude imbalance between an output signal the second annular portion 230 provides to the second patch antenna 120B (FIG. 1) via the fourth leg 234 (FIG. 4) and an output signal the second annular portion 230 provides to the first patch antenna 120A (FIG. 1) via the third leg 232 (FIG. 4). Curve 1910 depicts an amplitude imbalance between an output signal the third annular portion 240 provides to third patch antenna 120C (FIG. 1) via the fifth leg 242 (FIG. 4) and the output signal the second annular portion 230 provides to the first patch antenna 120A via the third leg 232. Curve 1920 depicts an amplitude imbalance between an output signal the third annular portion 240 provides to the fourth patch antenna 120D (FIG. 1) via the sixth leg 244 (FIG. 4) and the output signal the second annular portion 230 provides to the first patch antenna 120A via the third leg 232. As shown, curves 1910, 1920, 1930 indicate the amplitude imbalance of the sequential phase feed network 200 is less than 0.5 decibels over the range of frequencies.

Figure 20:
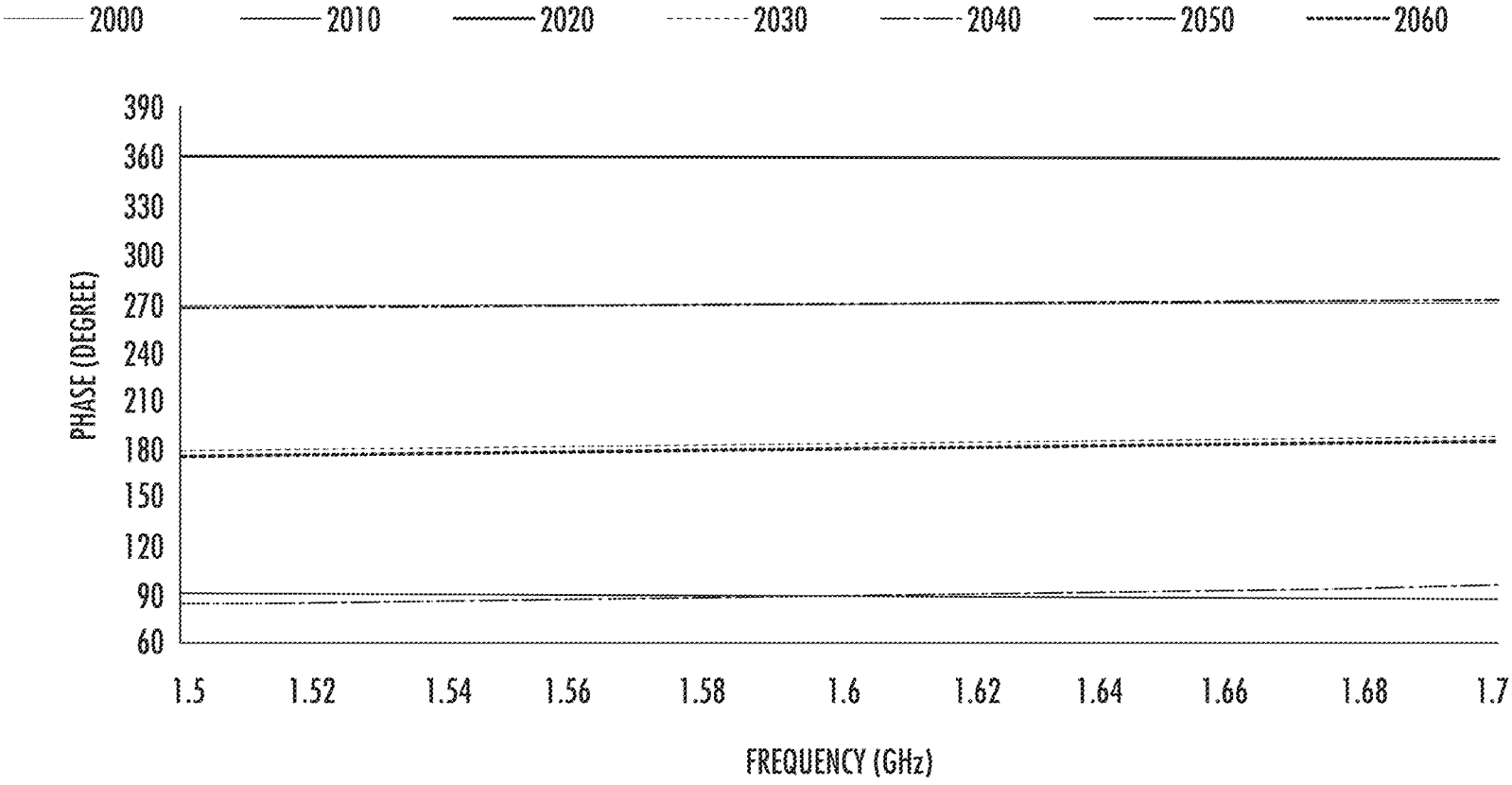
FIG. 20 depicts a graphical representation of the phase difference of a sequential phase feed network according to example embodiments of the present disclosure.

Referring now to FIG. 20, a graphical representation of the output signals of each of the patch antennas 120A-D is provided over a range of frequencies (e.g., 1500 MHz to 1700 MHz) according to example embodiments of the present disclosure. Line 2000 depicts a phase difference between an output signal the fourth annular portion 250 (FIG. 4) of the sequential phase feed network 200 provides to the first patch antenna 120A (FIG. 1) via the seventh leg 252 and an output signal the fourth annular portion 250 provides to the first patch antenna 120A via the eight leg 254. More specifically, line 2000 indicates the two output signals are out of phase by about 270 degrees. Line 2010 depicts a phase difference between an output signal the fifth annular portion 260 provides to the second patch antenna 120B via the tenth leg 264 and the output signal the fourth annular portion 250 provides to the first patch antenna 120A via the eight leg 254. More specifically, line 2010 indicates the two output signals are out of phase by about 90 degrees. Line 2020 depicts an output signal the fifth annular portion 260 provides to the second patch antenna 120B via the ninth leg 262 (FIG. 4) being in phase with the output signal the fourth annular portion 250 provides to the first patch antenna 120A via the eight leg 254. Line 2030 depicts the output signal the seventh annular portion 280 (FIG. 4) of the sequential phase feed network 200 provides to the third patch antenna 120C (FIG. 1) via the twelfth leg 274 and the output signal the fourth annular portion 250 provides to the first patch antenna 120A via the eight leg 254. More specifically, line 2030 indicates the two output signals are out of phase by about 180 degrees. Line 2040 depicts a phase difference between the output signal the seventh annular portion 280 provides to the third patch antenna 120C via the eleventh leg 272 (FIG. 4) and the output signal the fourth annular portion 250 provides to the first patch antenna 120A via the eight leg 254. More specifically, line 2040 indicates the two output signals are out of phase by about 90 degrees. Line 2050 depicts a phase difference between the output signal the seventh annular portion 280 (FIG. 4) of the sequential phase feed network 200 provides to the fourth patch antenna 120D via the thirteenth leg 282 and the output signal the fourth annular portion 250 provides to the first patch antenna 120A via the eight leg 254. More specifically, line 2050 indicates the two output signals are out of phase by about 90 degrees. Line 2060 depicts a phase difference between the output signal the seventh annular portion 280 provides to the fourth patch antenna 120D via the fourteenth leg 284 and the output signal the fourth annular portion 250 provides to the first patch antenna 120A via the eight leg 254. More specifically, line 2060 indicates the two output signals are out of phase by about 180 degrees.

Figure 21:
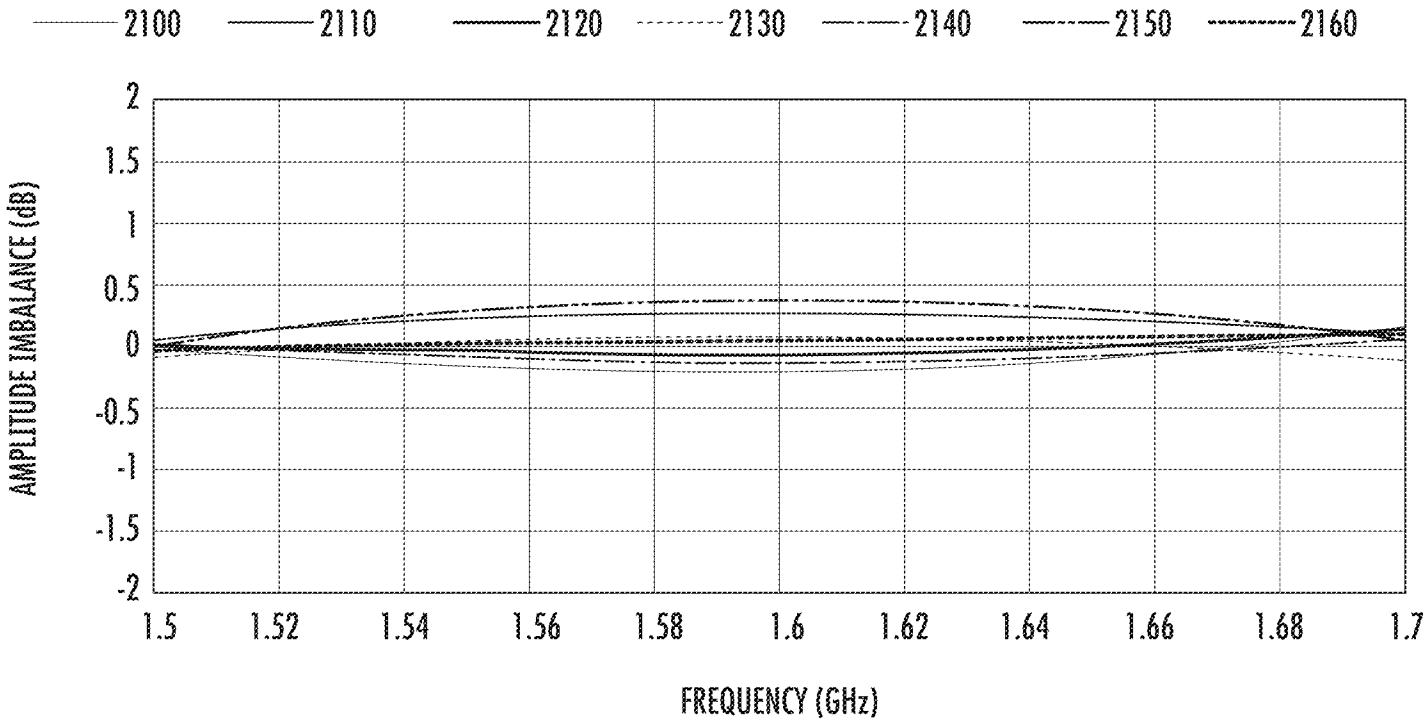
FIG. 21 depicts a graphical representation of an amplitude imbalance of a sequential phase feed network according to example embodiments of the present disclosure.

Referring now to FIG. 21, a graphical representation of an amplitude imbalance of a sequential phase feed network over a range of frequencies (e.g., 1500 MHz to 1700 MHz) is provided according to example embodiments of the present disclosure. Curve 2100 depicts an amplitude imbalance between an output signal the fourth annular portion 250 (FIG. 4) of the sequential phase feed network 200 provides to the first patch antenna 120A (FIG. 1) via the seventh leg 252 and an output signal the fourth annular portion 250 provides to the first patch antenna 120A via the eight leg 254. Curve 2110 depicts an amplitude imbalance between an output signal the fifth annular portion 260 provides to the second patch antenna 120B via the tenth leg 264 and the output signal the fourth annular portion 250 provides to the first patch antenna 120A via the eight leg 254. Curve 2120 depicts an amplitude imbalance between an output signal the fifth annular portion 260 provides to the second patch antenna 120B via the ninth leg 262 (FIG. 4) being in phase with the output signal the fourth annular portion 250 provides to the first patch antenna 120A via the eight leg 254. Curve 2130 depicts an amplitude imbalance between the seventh annular portion 280 (FIG. 4) of the sequential phase feed network 200 provides to the third patch antenna 120C (FIG. 1) via the twelfth leg 274 and the output signal the fourth annular portion 250 provides to the first patch antenna 120A via the eight leg 254. Curve 2140 depicts an amplitude between the output signal the seventh annular portion 280 provides to the third patch antenna 120C via the eleventh leg 272 (FIG. 4) and the output signal the fourth annular portion 250 provides to the first patch antenna 120A via the eight leg 254. Curve 2150 depicts an amplitude imbalance between the output signal the seventh annular portion 280 (FIG. 4) of the sequential phase feed network 200 provides to the fourth patch antenna 120D via the thirteenth leg 282 and the output signal the fourth annular portion 540 provides to the first patch antenna 120A via the eight leg 254. Curve 2160 depicts an amplitude imbalance between the output signal the seventh annular portion 280 provides to the fourth patch antenna 120D via the fourteenth leg 284 and the output signal the fourth annular portion 250 provides to the first patch antenna 120A via the eight leg 254. It should be appreciated that the curves 2100, 2110, 2120, 2130, 2130, 2140, 2150, 2160 indicate the amplitude imbalance of the sequential phase feed network 200 is less than 0.5 decibels over the range of frequencies.

While the present subject matter has been described in detail with respect to specific example embodiments thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

What is claimed is:

1. A patch antenna array system comprising:

a plurality of patch antennas oriented with respect to each other to provide a nearly symmetric radiation pattern over a range of frequencies, each of the plurality of patch antennas defining a plurality of apertures, each of the apertures positioned closer to a periphery of a corresponding patch antenna of the plurality of patch antennas than a center of the corresponding patch antenna, each of the plurality of patch antennas including at least one feed leg, the at least one feed leg comprising a first portion and a second portion, the first portion oriented in a first plane, the second portion oriented in a second plane that is different than the first plane;

a plurality of spacers, each of the plurality of spacers comprising one or more pegs, the one or more pegs positioned within a corresponding aperture of the plurality of apertures defined by a corresponding patch antenna of the plurality of patch antennas; and a sequential phase feed network in communication with the plurality of patch antennas, the sequential phase feed network configured to provide a RF signal to each of the plurality of patch antennas such that the nearly symmetric radiation pattern has an axial ratio of less than 1 decibel over the range of frequencies.

2. The patch antenna array system of claim 1, wherein the plurality of patch antennas are rotated relative to each other.

3. The patch antenna array system of claim 2, wherein the plurality of patch antennas include:

a first patch antenna;

a second antenna rotated about ninety degrees relative to the first patch antenna;

a third patch antenna rotated about one hundred and eighty degrees relative to the first patch antenna; and a fourth antenna rotated about two hundred and seventy degrees relative to the first patch antenna.

4. The patch antenna array system of claim 3, wherein:

the RF signal provided to the second antenna is about ninety degrees out-of-phase relative to the RF signal provided to the first patch antenna;

the RF signal provided to the third patch antenna is about one hundred and eighty degrees out-of-phase relative to the RF signal provided to the first patch antenna; and the RF signal provided to the fourth antenna is about two hundred and seventy degrees out-of-phase relative to the RF signal provided to the first patch antenna.

5. The patch antenna array system of claim 1, wherein the nearly symmetric radiation pattern comprises a circular polarization pattern.

6. The patch antenna array system of claim 1, wherein the at least one feed leg further comprises a third portion positioned within a third plane that is parallel to the first plane, and wherein the first plane is orthogonal to the second plane.

7. The patch antenna array system of claim 6, wherein a shape of the second portion corresponds to a trapezoid.

8. The patch antenna array system of claim 7, wherein each of the plurality of patch antennas is coupled to the sequential phase feed network via the third portion of the at least one feed leg.

9. The patch antenna array system of claim 6, wherein the sequential phase feed network includes:

a first annular portion configured to receive the RF signal from a RF source;

a second annular portion in electrical communication with the first annular portion via a first leg extending from the first annular portion;

a third annular portion in electrical communication with the first annular portion via a second leg extending from the first annular portion;

a fourth annular portion in electrical communication with the second annular portion via a third leg extending from the second annular portion;

a fifth annular portion in electrical communication with the second annular portion via a fourth feed leg extending from the second annular portion;

a sixth annular portion in electrical communication with the third annular portion via a fifth feed leg extending from the third annular portion; and a seventh annular portion in electrical communication with the third annular portion via a sixth feed leg extending from the third annular portion.

10. The patch antenna array system of claim 9, wherein the plurality of patch antennas include:

a first patch antenna positioned over the fourth annular portion;

a second patch antenna positioned over the fifth annular portion;

a third patch antenna positioned over the sixth annular portion; and a fourth patch antenna positioned over the seventh annular portion.

11. The patch antenna array system of claim 10, wherein:

the at least one feed leg of the first patch antenna is in electrical communication with the fourth annular portion;

the at least one feed leg of the second patch antenna is in electrical communication with the fifth annular portion;

the at least one feed leg of the third patch antenna is in electrical communication with the sixth annular portion; and the at least one feed leg of the fourth patch antenna is in electrical communication with the seventh annular portion.

12. The patch antenna array system of claim 6, wherein the at least one feed leg comprises a first leg and a second leg that is rotated relative to the first leg.

13. The patch antenna array system of claim 1, wherein the range of frequencies spans from 1500 MegaHertz to 1700 MegaHertz.

14. The patch antenna array system of claim 1, wherein the range of frequencies includes a first band of frequencies, a second band of frequencies, a third band of frequencies, and a fourth band of frequencies, wherein the first band of frequencies spans from about 1525 MHz to about 1550 MHz, wherein the second band of frequencies spans from about 1616 MHz to about 1626 MHz, wherein the third band of frequencies spans from about 1626 MHz to about 1660 MHz, and wherein the fourth band of frequencies spans from about 1563 MHz to about 1587 MHz.

15. A patch antenna array system comprising a plurality of patch antennas, the patch antenna array system comprising:

a plurality of spacers secured to a circuit board such that each of the plurality of spacers is positioned at a different location on the circuit board, each of the plurality of spacers comprising one or more pegs positioned within a corresponding aperture of a plurality of apertures defined by the circuit board; and a sequential phase feed network configured to provide a RF signal to each of the plurality of patch antennas of the patch antenna array system, the sequential phase feed network comprising:

a first annular portion disposed on the circuit board, the first annular portion configured to receive an RF signal from an RF source;

a second annular portion disposed on the circuit board, the second annular portion in electrical communication with the first annular portion via a first leg extending from the first annular portion;

a third annular portion in electrical communication with the first annular portion via a second leg extending from the first annular portion;

a fourth annular portion positioned within a perimeter of a first spacer of the plurality of spacers, the fourth annular portion in electrical communication with the second annular portion via a third leg extending from the second annular portion;

a fifth annular portion positioned within a perimeter of a second spacer of the plurality of spacers, the fifth annular portion in electrical communication with the second annular portion via a fourth feed leg extending from the second annular portion;

a sixth annular portion positioned within a perimeter of a third spacer of the plurality of spacers, the sixth annular portion in electrical communication with the third annular portion via a fifth feed leg extending from the third annular portion; and a seventh annular portion positioned within a perimeter of a fourth spacer of the plurality of spacers, the seventh annular portion in electrical communication with the third annular portion via a sixth feed leg extending from the third annular portion.

16. The patch antenna array system of claim 15, wherein:

a first patch antenna of the plurality of patch antennas is positioned over the fourth annular portion;

a second patch antenna of the plurality of patch antennas is positioned over the fifth annular portion;

a third patch antenna of the plurality of patch antennas is positioned over the sixth annular portion; and a fourth patch antenna of the plurality of patch antennas is positioned over the seventh annular portion.

17. The patch antenna array system of claim 16, wherein:

at least one feed leg of the first patch antenna is in electrical communication with the fourth annular portion;

at least one feed leg of the second patch antenna is in electrical communication with the fifth annular portion;

at least one feed leg of the third patch antenna is in electrical communication with the sixth annular portion; and at least one feed leg of the fourth patch antenna is in electrical communication with the seventh annular portion.

18. The patch antenna array system of claim 1, wherein the second plane is orthogonal to the first plane.

19. The patch antenna array system of claim 15, wherein each of the plurality of patch antennas is secured to a corresponding spacer of the plurality of spacers.

20. The patch antenna array system of claim 15, wherein the one or more pegs are positioned within a corresponding aperture of a plurality of apertures defined by a corresponding patch antenna of the plurality of patch antennas.

* * * * *